US008684066B2

(12) United States Patent
Ni et al.

(10) Patent No.: US 8,684,066 B2
(45) Date of Patent: Apr. 1, 2014

(54) OVERHEAD GARAGE DOOR

(76) Inventors: Xiao-Ming Ni, Zhejiang (CN); Jennifer Armstrong Maher, Chevy Case, MD (US)

( * ) Notice: Subject to any disclaimer, the term of this patent is extended or adjusted under 35 U.S.C. 154(b) by 0 days.

(21) Appl. No.: 12/893,636

(22) Filed: Sep. 29, 2010

(65) Prior Publication Data

US 2011/0198043 A1 Aug. 18, 2011

Related U.S. Application Data

(63) Continuation of application No. 11/277,466, filed on Mar. 24, 2006, now Pat. No. 7,857,032, which is a continuation-in-part of application No. 11/328,454, filed on Jan. 10, 2006, now Pat. No. 7,766,069, and a continuation-in-part of application No. 11/229,713, filed on Sep. 20, 2005, now abandoned, which is a continuation of application No. 10/098,384, filed on Mar. 18, 2002, now Pat. No. 6,948,547.

(30) Foreign Application Priority Data

Mar. 13, 2006 (CN) ..... 2006 3 1055417
Mar. 13, 2006 (CN) ..... 2006 3 1055421

(51) Int. Cl.
*E06B 3/48* (2006.01)

(52) U.S. Cl.
USPC ..... 160/229.1; 160/40; 160/201

(58) Field of Classification Search
USPC ..... 160/201, 229.1, 40, 236, 235; 49/383, 49/496.1, 483.1; 16/355
See application file for complete search history.

(56) References Cited

U.S. PATENT DOCUMENTS

| | | | | |
|---|---|---|---|---|
| 3,221,465 | A | 12/1965 | McKee | |
| 3,941,180 | A * | 3/1976 | Thill | 160/229.1 |
| 5,133,108 | A | 7/1992 | Esnault | |
| 5,148,850 | A | 9/1992 | Urbanick | |
| 5,566,740 | A | 10/1996 | Mullet et al. | |
| 5,626,176 | A | 5/1997 | Lewis et al. | |
| 5,709,259 | A | 1/1998 | Lewis et al. | |
| 5,782,283 | A | 7/1998 | Kendall | |
| 5,857,510 | A | 1/1999 | Krupke et al. | |
| 5,934,352 | A | 8/1999 | Morgan | |
| 5,992,497 | A | 11/1999 | Jaehnen et al. | |
| 6,076,590 | A | 6/2000 | Ford et al. | |
| 6,098,697 | A | 8/2000 | Krupke et al. | |
| 6,227,281 | B1 | 5/2001 | Martin | |
| 6,328,091 | B1 | 12/2001 | Whitley | |
| 6,363,993 | B1 | 4/2002 | Aquilina | |

(Continued)

FOREIGN PATENT DOCUMENTS

| | | |
|---|---|---|
| DE | 10310628 A1 | 10/2004 |
| WO | 9841723 | 9/1998 |
| WO | 2004029395 A2 | 4/2004 |

OTHER PUBLICATIONS

International Search Report dated Nov. 21, 2007.

*Primary Examiner* — Blair M. Johnson

(57) ABSTRACT

An overhead garage door has an apparatus for pinch resistant operation. The garage door may include horizontal sections and the door may be formed from a plurality of these sections, arranged in a stack, and pivotally connected to adjacent sections. The apparatus, such as meeting rails, may be attached to adjacent horizontal sections to mask the appearance of a seam created as adjacent sections are joined or provide pinch resistant operation.

14 Claims, 20 Drawing Sheets

(56) References Cited

U.S. PATENT DOCUMENTS

| | | | | |
|---|---|---|---|---|
| 6,408,486 | B1 | 6/2002 | Saliba et al. | |
| 6,527,036 | B1 | 3/2003 | Welsh | |
| 6,578,619 | B2 | 6/2003 | Wright | |
| 6,626,226 | B2 | 9/2003 | Whitley | |
| 6,629,387 | B2 | 10/2003 | Whitley et al. | |
| 6,672,362 | B1 | 1/2004 | Mullet et al. | |
| 6,810,938 | B2 | 11/2004 | Aquilina | |
| 6,843,300 | B2 | 1/2005 | Mullet et al. | |
| 6,883,578 | B2 | 4/2005 | Whitley | |
| 6,899,157 | B2 | 5/2005 | Mullet | |
| 6,935,400 | B1 | 8/2005 | Welsh | |
| 6,942,000 | B2 | 9/2005 | Hoerner et al. | |
| 6,948,547 | B2 * | 9/2005 | Maher | 160/201 |
| 6,955,206 | B2 | 10/2005 | Mullet et al. | |
| 7,766,069 | B2 * | 8/2010 | Ni et al. | 160/229.1 |
| 7,770,624 | B2 * | 8/2010 | Ni et al. | 160/229.1 |
| 7,857,032 | B2 * | 12/2010 | Ni et al. | 160/229.1 |
| 7,866,368 | B2 | 1/2011 | Ostrovsky et al. | |
| 2003/0000656 | A1 | 1/2003 | Zen | |
| 2004/0069421 | A1 | 4/2004 | Mullet | |
| 2005/0269043 | A1 | 12/2005 | Welsh | |
| 2007/0175602 | A1 | 8/2007 | Ni et al. | |

* cited by examiner

OVERHEAD GARAGE DOOR

CROSS REFERENCE TO RELATED APPLICATIONS

This application is a continuation of U.S. pending application Ser. No. 11/277,466, filed Mar. 24, 2006, which claims the benefit of priority to Chinese Design Patent Application Nos. 200630105541.7 and 200630105542.1, both filed on Mar. 13, 2006 in China. U.S. application Ser. No. 11/277,466, filed Mar. 24, 2006 is a continuation-in-part of the U.S. patent application Ser. No. 11/328,454, filed Jan. 10, 2006 now U.S. Pat. No. 7,766,069, which is a continuation-in-part of U.S. patent application Ser. No. 11/229,713 filed Sep. 20, 2005, which is a continuation of U.S. patent application Ser. No. 10/098,384, filed Mar. 18, 2002, now U.S. Pat. No. 6,948,547, entitled "Overhead Garage Door With Decorative Facade Elements." The contents of the noted above applications are expressly incorporated herein by reference.

TECHNICAL FIELD

This invention generally pertains to a sectional door having an apparatus for pinch resistant operation. More particularly, the present invention pertains to a sectional door pinch resistant apparatus that conceals seam lines between hingedly-connected sections of a sectional door, such as an overhead garage door, and to an overhead garage door having the same.

BACKGROUND

Garage doors are generally known in the art as structures that form a movable barrier in an entryway to a garage or other type of building. Conventional overhead garage doors are formed from a vertical stack of horizontally folding sections interconnected by hinges and supported by a guide track.

Visible seams are created in these conventional doors where the horizontal panels of the door meet when in the closed, vertical position. These seams detract from the aesthetics of the door and may allow moisture, wind and debris to penetrate through the garage door. Repeated use of the door over extended periods may cause these seams to widen further, allowing more moisture, wind and debris into the garage, reducing the insulation capabilities of the door and further detracting from the aesthetics of the door.

In additional, conventional doors have a problem of a user's finger being potential engaged between the door sections on a closing operation. This problem is a hazard has not been adequately addressed by previous door designs.

SUMMARY

Aspects of the present invention provide a sectional door having pinch resistant apparatus between hingedly-connected sections of the door when the door is moved in a closed position. In addition, aspects of the present invention provide good sealing capabilities at the seams of such a door in a closed position to prevent moisture, wind and debris from penetrating through the door. Further aspects provide an overhead garage door formed of hingedly-connected sections that interconnect while in the closed position to provide a robust, rigid door.

In one embodiment, a sectional door includes a set of meeting rails installed on adjacent, hingedly-connected sections of the door. The meeting rails mask the seam created where the adjacent sections meet when in a closed position. In addition, the meeting rails can provide improved sealing and insulation for the door by providing a barrier against moisture, wind and debris.

DETAILED DESCRIPTION OF THE DRAWINGS

Figure 1:
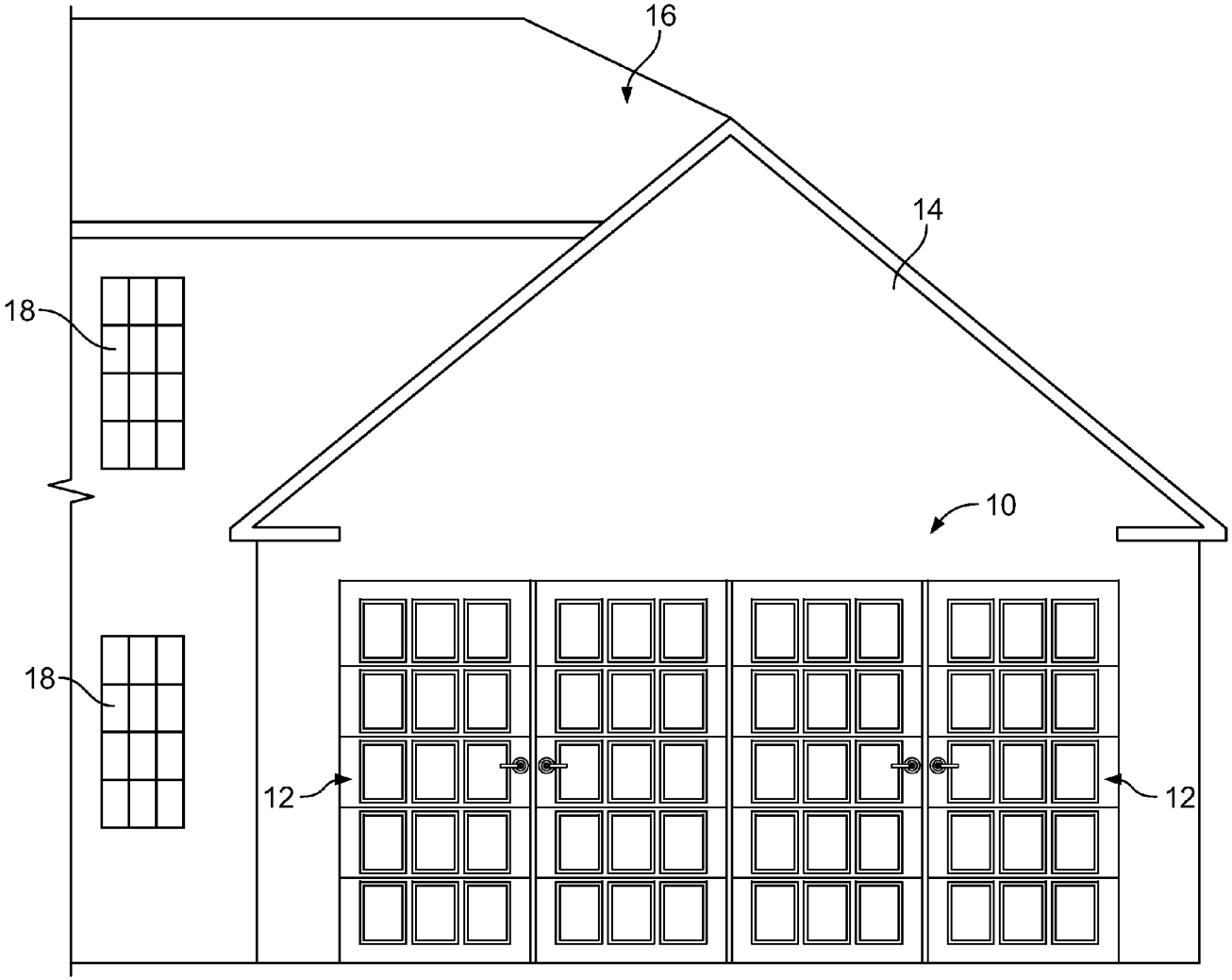
FIG. 1 shows a portion of a house with an attached garage having an embodiment of an overhead garage door in accordance with the present invention.

One embodiment of the present invention is the overhead garage door 10 depicted in FIG. 1 that includes decorative faøade elements 12 that simulate a set of four light-transmitting doors known commonly as French doors. A set of French doors typically includes two doors each having an array of divided lights. In the garage door 10, the lights are light-transmitting panels that transmit visible light.

Figure 2:
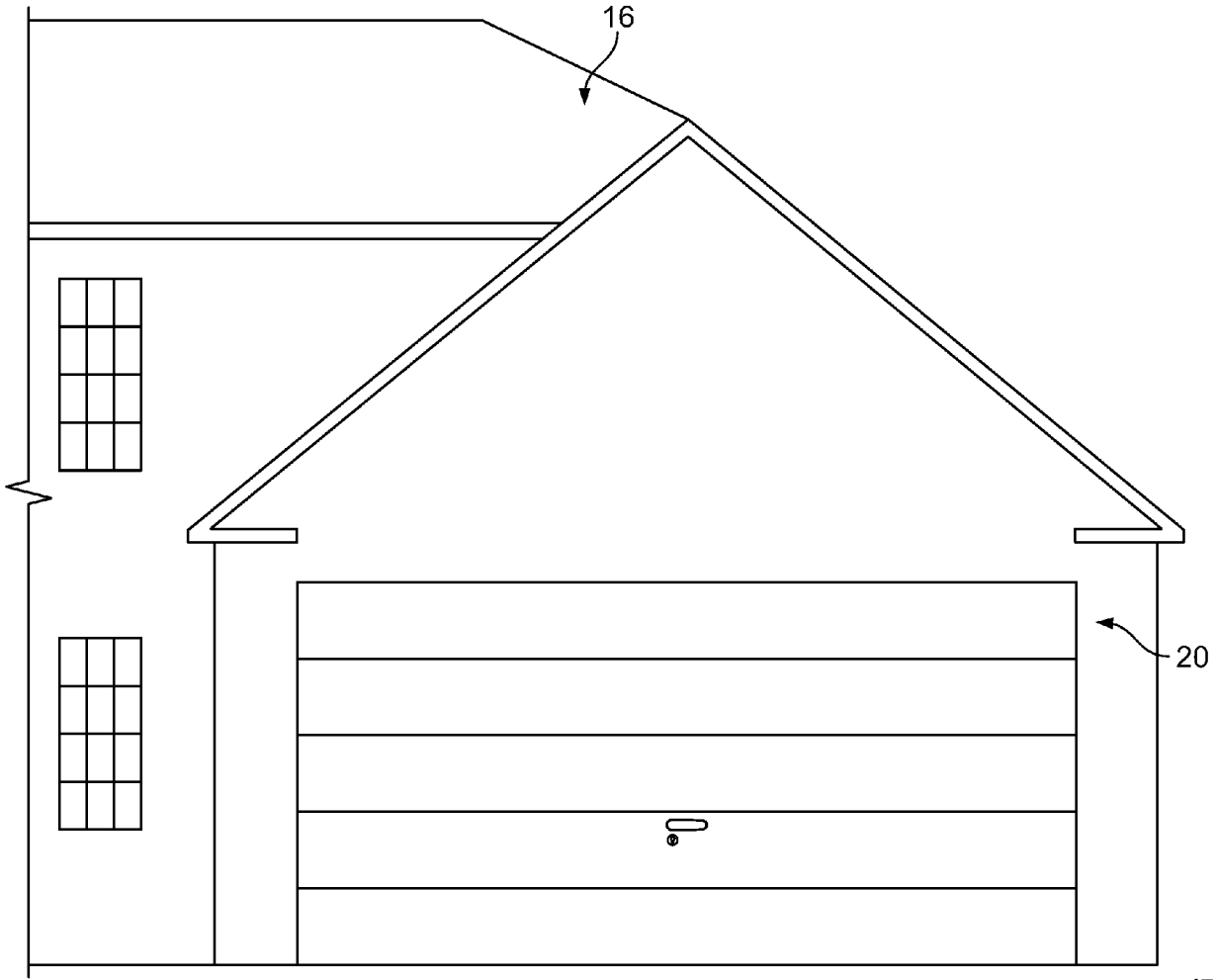
FIG. 2 (Prior Art)
FIG. 2 shows the house of FIG. 1, but with a conventional overhead garage door.

The garage door 10 is shown installed on a garage 14 of a conventional house 16. For illustration purposes, the house includes divided light windows 18. The faøade elements 12 give the garage door 10 an attractive appearance that blends well with the style of the house 16, particularly with the divided light windows 18 of the house. In contrast, FIG. 2 shows a conventional garage door installed on the same conventional house 16. Rather than blending in with the style of the house 16, the conventional garage door 20 stands out as a monolithic blank space that detracts from the appearance of the house.

Figure 3:
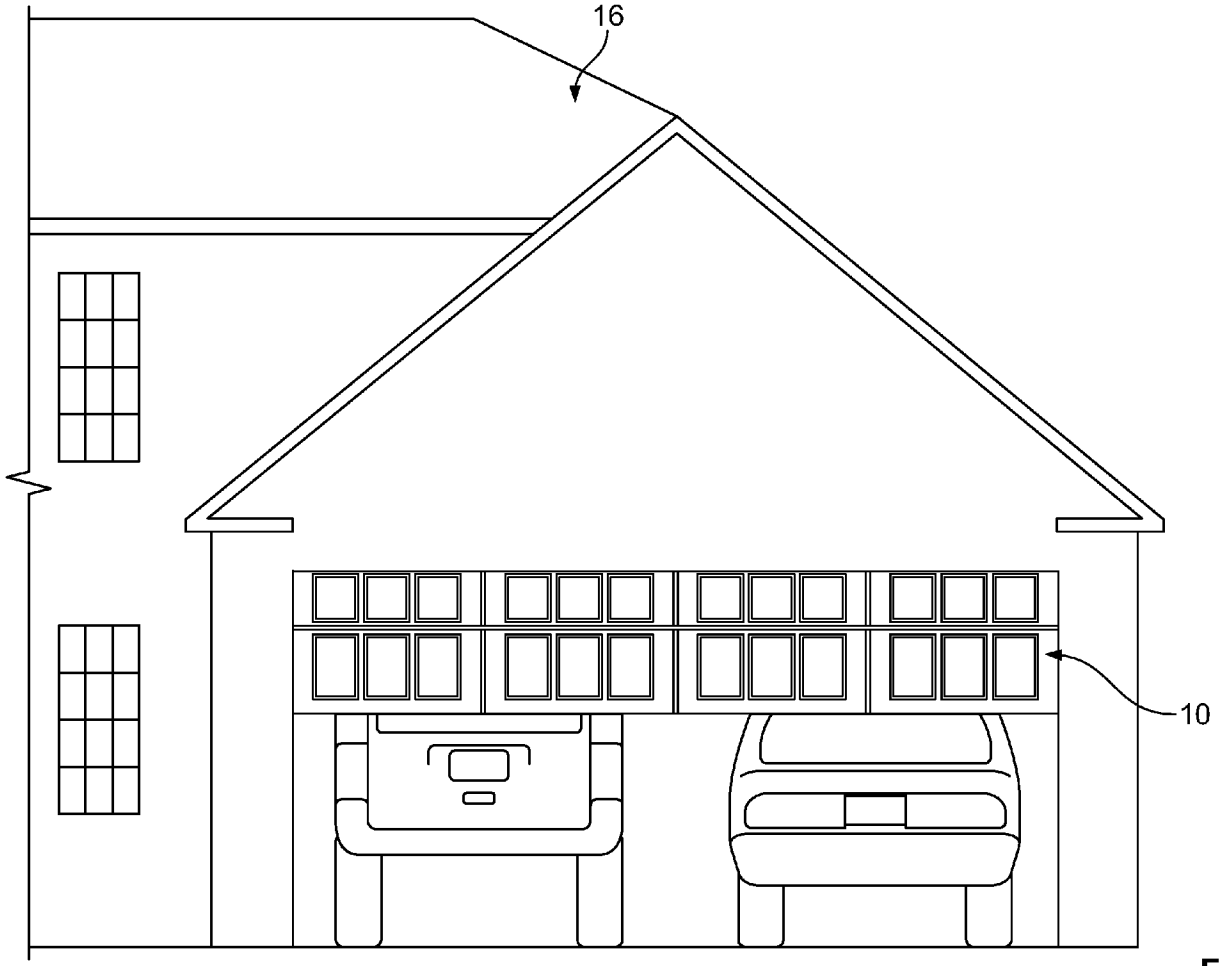
FIG. 3 shows the garage door of FIG. 1, but with the overhead garage door shown in a partially opened condition.

Referring now to FIGS. 4-7, the overhead garage door 10 includes a door 22, four arrays 24 of light-transmitting panels 26, guide rollers 28, and guide tracks 30. The door 22 includes sections 32 arranged in a stack, and hinges 34 pivotally connecting adjacent sections 32. Guide rollers 28 are connected to edge portions of the sections 32 and are retained in a guide track 30 attached to the garage. The track has a vertical section and a horizontal section and extends at a right angle from a vertical position to a horizontal position. The guide rollers 28 are each received in a channel 31 in one of the guide tracks 30. The garage door 12 opens and closes by rolling on the guide rollers along the guide tracks 30 from a vertical closed position to an overhead horizontal open position, and vice versa, as is known in the art. To illustrate, FIG. 3 shows garage door 10 in a position intermediate between the opened and closed position. Although embodied herein as a sectioned garage door, the present invention works as well with unitary, slab-type overhead garage doors as are known in the art, or with other types of overhead garage doors.

Figure 4:
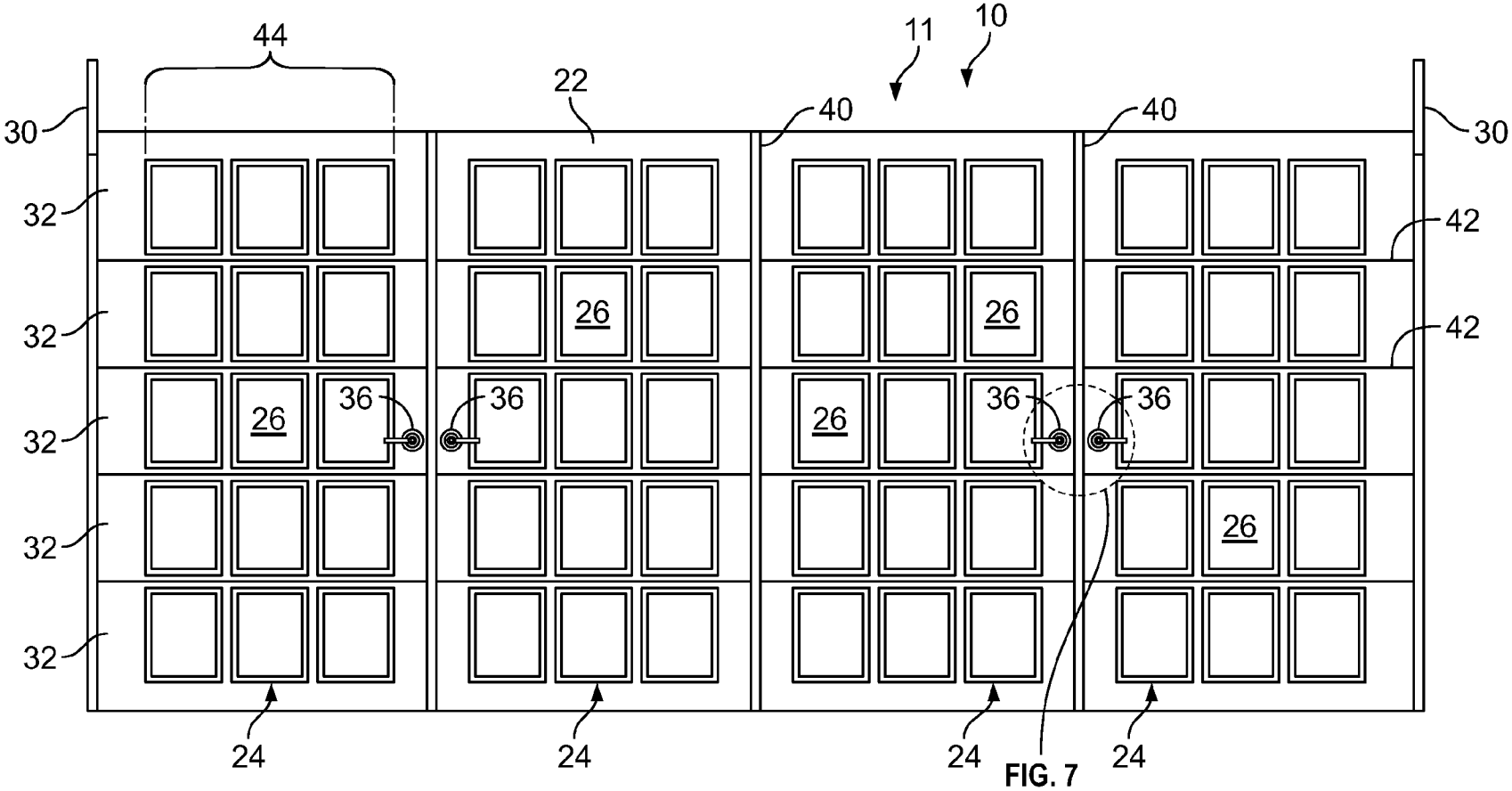
FIG. 4 is an exterior elevational view of the garage door of FIG. 1, including guide rails for connecting the door to the garage.
Figure 5:
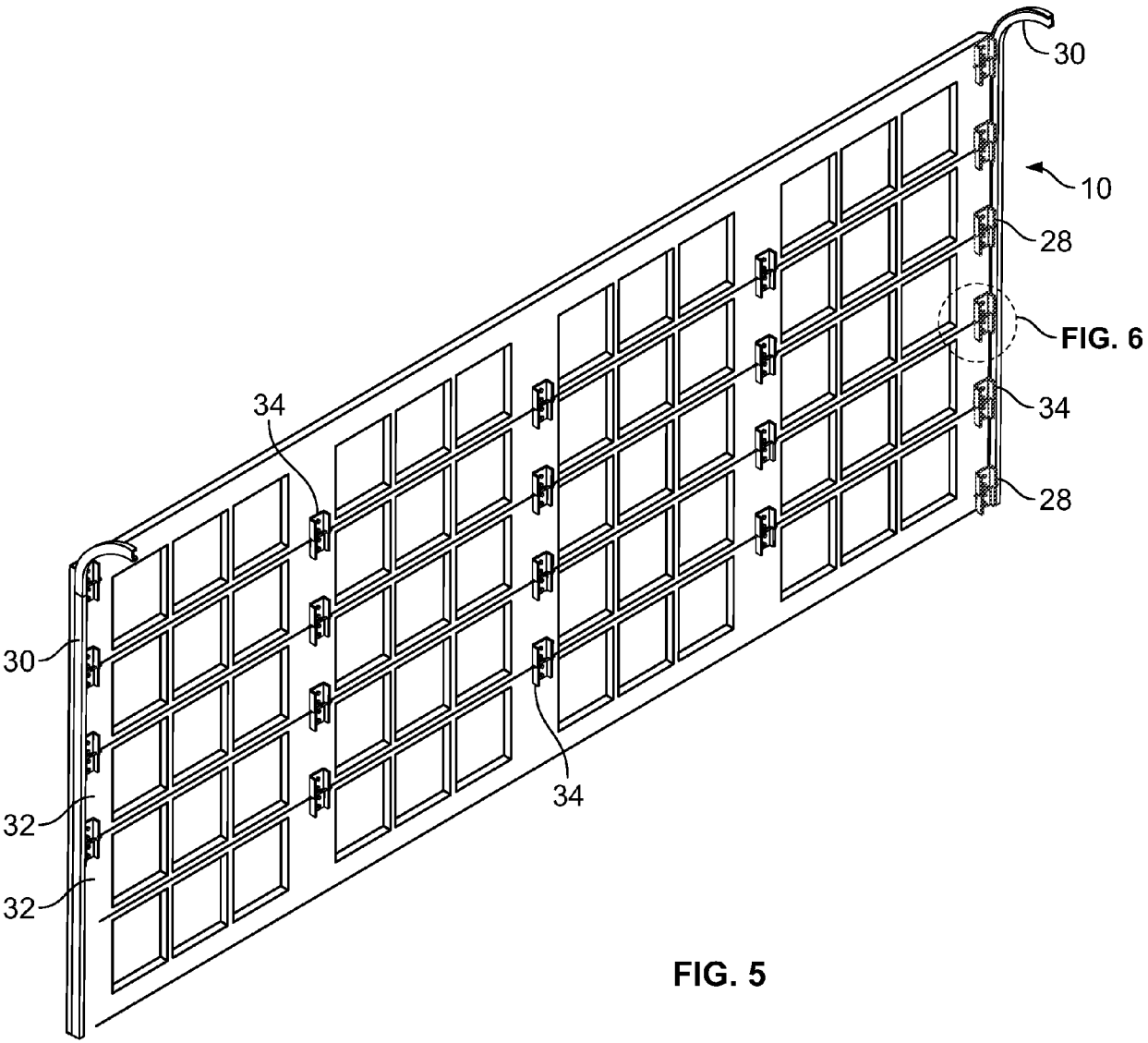
FIG. 5 shows an interior perspective view of the garage door of FIG. 4.
Figure 6:
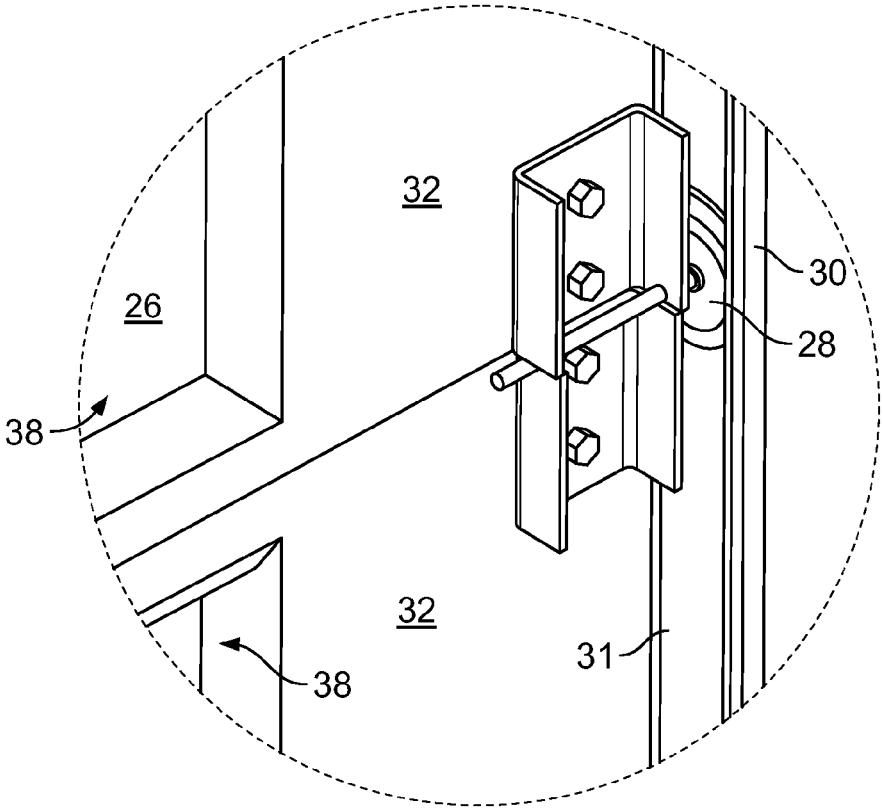
FIG. 6 shows a close-up perspective view of an interior portion of the garage door of FIG. 5, including a roller connected to a guide rail.
Figure 7:
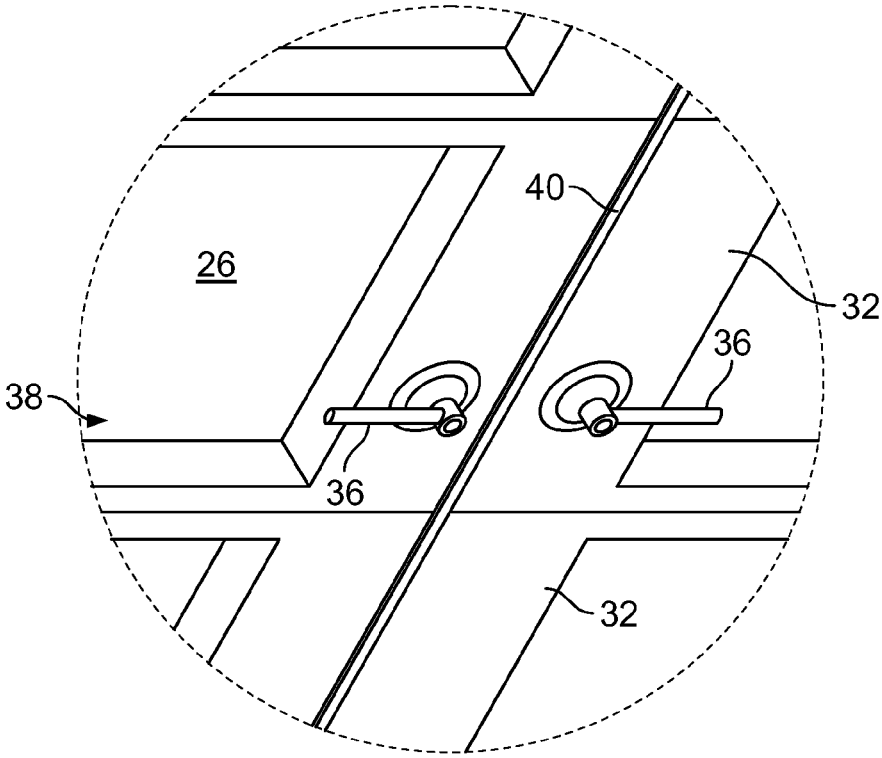
FIG. 7 shows a close-up perspective view of an exterior portion of the garage door of FIG. 4, including a vertical groove and door handles.

The arrays 24 of light-transmitting panels 26 shown in FIGS. 1 and 3-5 each include five rows by three columns, which generally match the appearance of regular French doors. The arrays 24 are spaced from one another along the door 22 to give the appearance of four separate passage doors. To enhance the appearance of separate doors, the overhead garage door 10 further includes door handles 36. Each array 24 in combination with a corresponding handle 36 generally forms a faøade element 12 to simulate a light-transmitting door. Although the door handles 36 do not function to open the simulated doors 24, they may act as functional latches for opening the garage door 10 or as handles for lifting the garage door 10. To further simulate the appearance of French doors, each one of the light-transmitting panels 26 appear to be glazed in a section 32 as shown in FIGS. 6 and 7, which is similar to the manner in which glass is often glazed in window frames. Accordingly, beveled moldings 38 are provided in the sections 32 for retaining the light-transmitting panels 26. The panels 26 retained therein are able to transmit light from the outside environment into the interior of the garage 14.

The light-transmitting panels 26 preferably are translucent panels, which provide the benefit of transmitting light between the outside environment and the interior of the garage 14 without allowing persons outside of the garage 14 to clearly see into the garage. Thus, the present invention allows in a greater amount of natural light into the garage 14 compared with a conventional garage door. According to other embodiments, the light-transmitting panels 26 may include transparent panels, reflective panels, tinted panels, one-way mirrored panels, and the like to provide a desired level of privacy without sacrificing light. Further, the door arrays 24 may include a mix of different panel types, and may include opaque panels. Thus, the quantity of light transmitted into and out of the garage 14 can be custom tailored according to the light transmissibility of each one of the panels 26.

The panels 26 are preferably made of material which can be customized in appearance and strong enough to be a barrier in an environment that is prone to weather exposure, shop conditions, or other adverse environments. One example of such a material is polycarbonate acrylic sheets, which are light-weight and provide high impact resistance. These sheets can be made to have various light transmission properties, which can range from transparent to opaque. Polycarbonate acrylic sheets can also be made in a variety of colors and tints. The present invention further contemplates panels 26 made from a wide variety of plastics, glass, or other light-transmitting materials.

To enhance the effect of the faøade elements 12 in simulating French doors, the door 22 also includes three vertical grooves 40. Each groove 40 is placed between a pair of panel arrays 24 to simulate the jambs of a set of adjacent doors. The grooves 40 additionally emphasize the appearance of simulated doors by drawing the eye away from the horizontal lines 42 created by the junction of adjacent sections 32. The grooves 40 are accentuated in comparison with the horizontal lines 42 by being much wider and deeper than the horizontal lines. Painting the grooves a dark color further increases their visual effect.

The garage door 10 of the present invention can be created from a kit 11 for making an overhead garage door that simulates a set of light-transmitting doors. Referring specifically to FIGS. 4 and 5, the kit 11 generally includes a number of sections 32 and a number of hinges 34 for connecting the sections 32. A row of light-transmitting panels 26 are mounted on each section 32, and the panels of each row are arranged in groups 44 of three panels spaced apart from adjacent groups. The garage door 10 is created by arranging the sections 32 into a stack to form the door 22, and connecting adjacent sections 32 to each other with hinges 34. The kit 11 also includes guide rollers 28 and guide tracks 30 for mounting the assembled door to a garage, and door handles 36 for mounting on one of sections 32.

Figure 14:
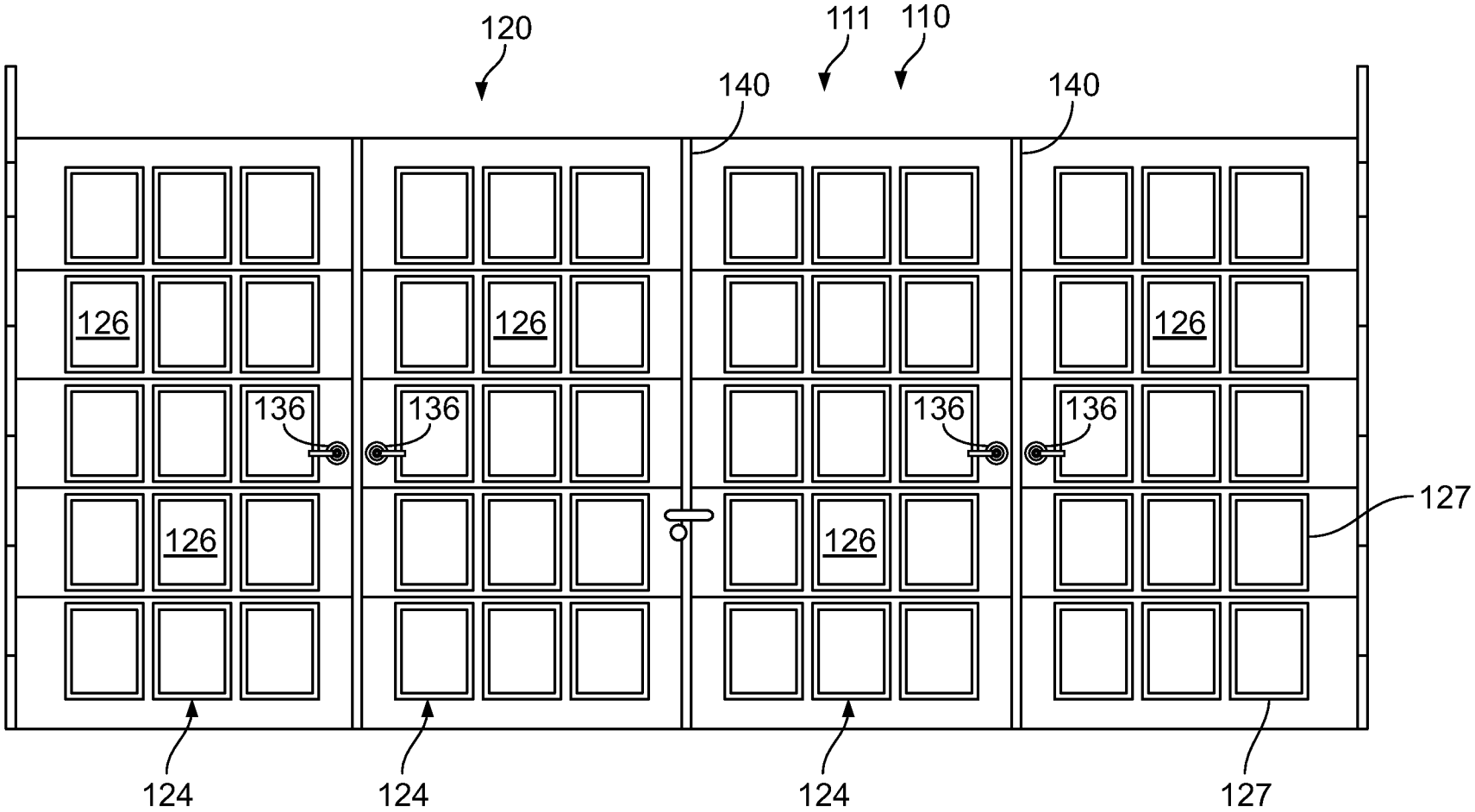
FIG. 14 shows an exterior elevational view of an additional embodiment of an overhead garage door in accordance with the present invention.

A garage door 110 according to another embodiment of the present invention can be created from a retrofit kit 111 for modifying the appearance of an existing overhead garage door to simulate a set of light-transmitting doors. Referring to FIG. 14, the retrofit kit 111 generally includes decorative panels 126 and door handles 136. The decorative panels 126 are mounted to a conventional garage door 120 (such as the conventional garage door 20 shown in FIG. 2) in a set of arrays 124 to give it the appearance of a set of French doors. In order to allow light to transmit through the panels 126, holes (not shown) may be cut into the garage door 120 prior to mounting the panels. The panels may be mounted over or within the holes (not shown) according to known methods. The panels may include beveled edges 127 to simulate the frame elements of a French door. The handles 136 are each mounted next to an array 124 to further simulate light-transmitting doors. An optional vertical stripe 140 may be painted onto the garage door 120 to simulate the jambs of adjacent simulated French doors.

Figure 8:
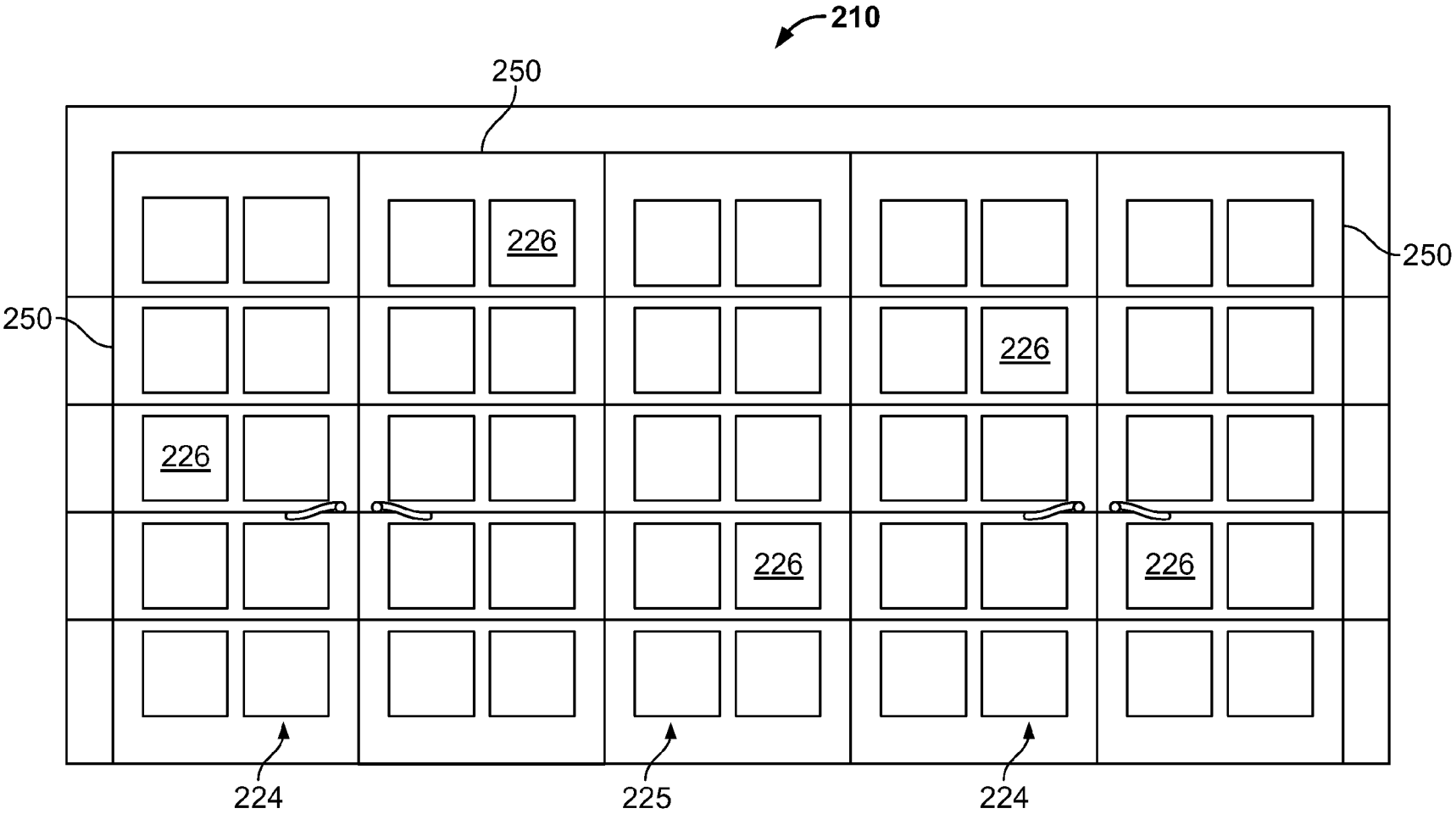
FIG. 8 shows an exterior elevational view of another embodiment of an overhead garage door in accordance with the present invention.

The present invention is flexible in that it allows for variety in the design of facades and in the types of light-transmitting doors simulated. For example, a further embodiment of an overhead garage door in accordance with the present invention is shown in FIG. 8. In this embodiment, there are five arrays 224 of light-transmitting panels 226 simulating a set of four light-transmitting doors centered about a window array 225. The arrays 224 are arranged into two by five arrays having two columns and five rows. The garage door 210 further includes borders 250 simulating the jambs and top edges of each simulated door and the window. The borders 250 are preferably formed by grooves in the garage door, but may also be formed from painted stripes, adhesive strips, and other methods for marking a border. Except for preferences and aspects related to number, arrangement and size of arrays 224, or to the simulated borders 250, all other preferences and aspects are generally the same as for the previous embodiments.

Figure 9:
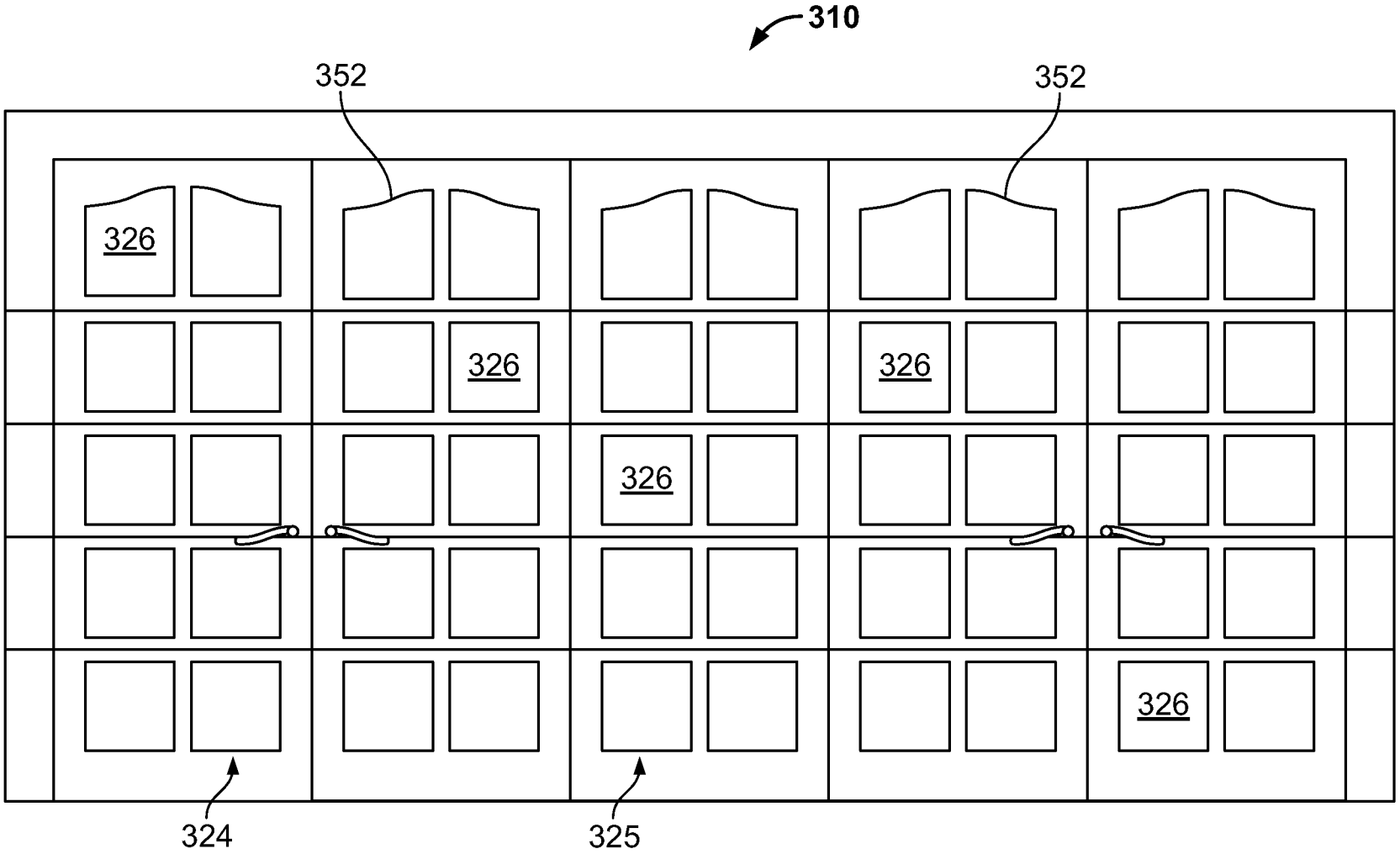
FIG. 9 shows an exterior elevational view of a further embodiment of an overhead garage door in accordance with the present invention.
Figure 10:
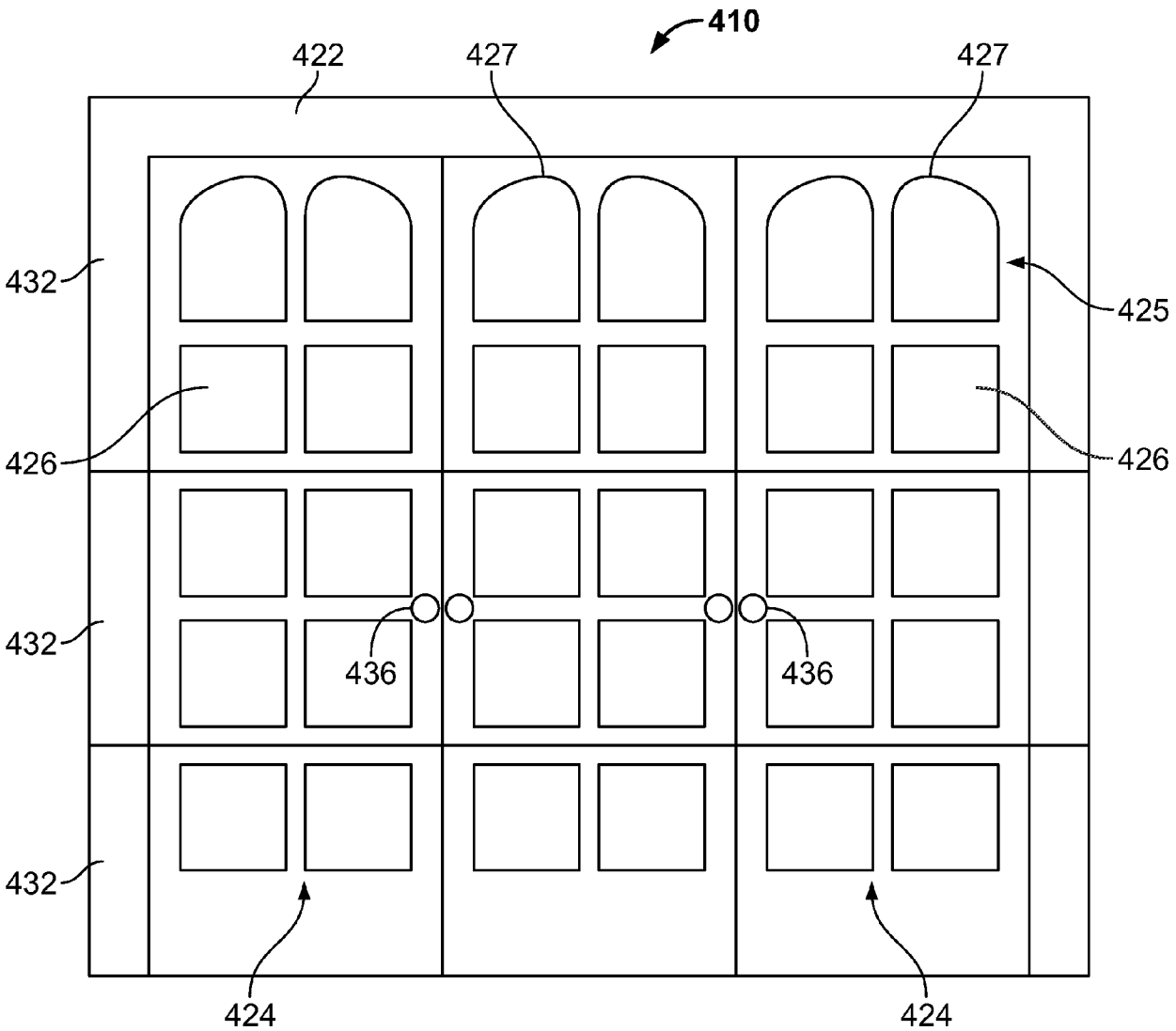
FIG. 10 shows an exterior elevational view of yet another embodiment of an overhead garage door in accordance with the present invention.
Figure 11:
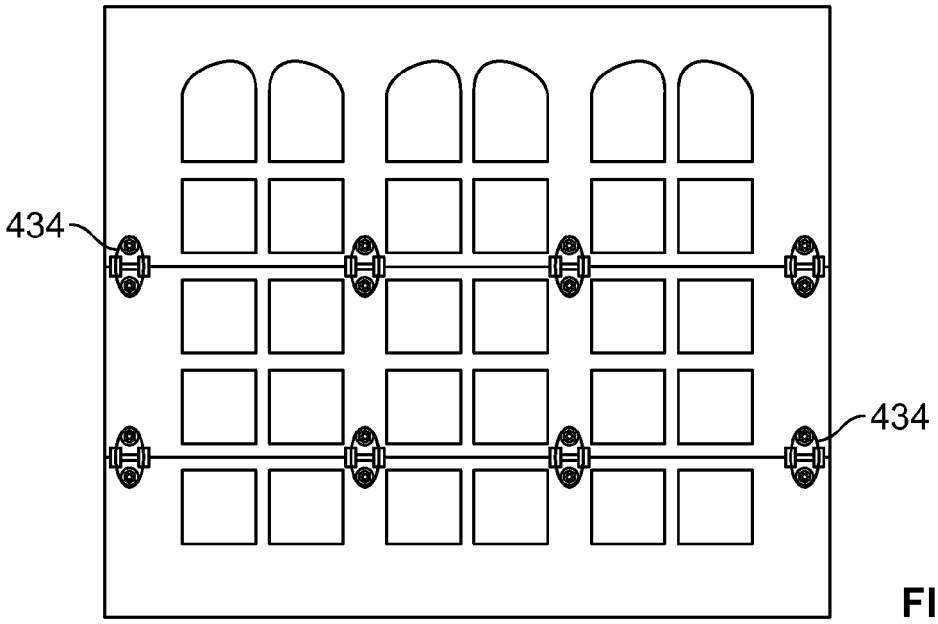
FIG. 11 shows an interior elevational view of the garage door of FIG. 10.
Figure 12:
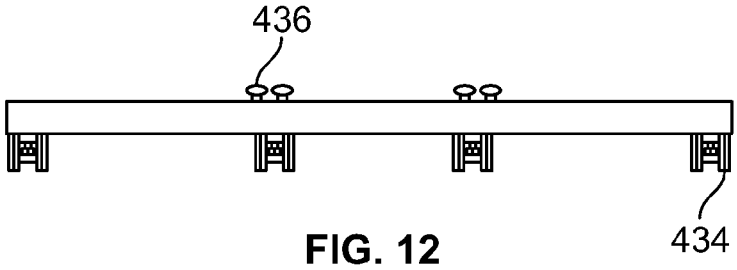
FIG. 12 shows a top view of the garage door of FIG. 10.
Figure 13:
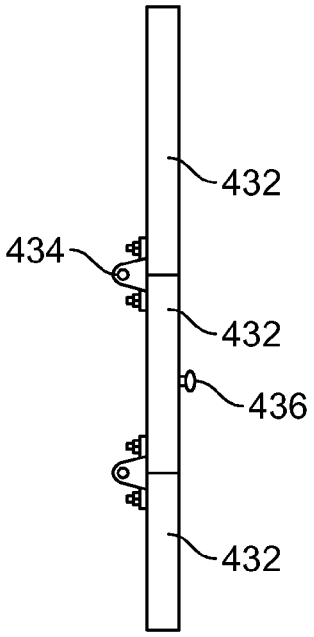
FIG. 13 shows a side view of the garage door of FIG. 10.

The present invention also provides flexibility in the size and type of panels used for the simulated light-transmitting doors. For example, an additional embodiment of an overhead garage door 310 in accordance with the present invention is shown in FIG. 9. This embodiment differs from the embodiment shown in FIG. 8 in that each panel in the top row of panels 326 include an ornate arching curvature 352 along its top edge. As illustrated in the top row 352, the panels 326 need not be rectangular or uniform in size and shape, and may include any number of decorative variations.

Referring now to FIGS. 10-13, yet another embodiment of an overhead garage door 410 in accordance with the present invention is shown. This embodiment demonstrates further flexibility in design according to the present invention, particularly for garage door design as well as for panel design and array layout. The garage door 410 according to this embodiment generally includes a door 422 and three arrays 424 of light-transmitting panels 426 simulating a set of three light-transmitting doors. The door 422 includes three sections 432 arranged in a vertical stack, and hinges 434 pivotally connecting adjacent ones of sections 432. The sections 432 in this embodiment are of different sizes, with the top section being wider than the middle section and bottom sections, and the middle section being wider than the bottom section. The arrays 424 are arranged into two by five arrays having two columns and five rows.

The garage door 410 represented by this embodiment demonstrates a number of design differences from other embodiments. For example, the panels 426 located in the top row 425 of each array are taller than the panels located in lower rows. In addition, each panel in the top row 425 has an arcuate top edge 427. Although the panels 426 are arranged into five rows, the panels are spaced over only three sections 432. Accordingly, the top two rows in each array are located on the top section, the middle two rows in each array are located on the middle section, and the lower row of each array is located on the lower section. As such, the simulated windows in each of the simulated doors appear to be upwardly offset from the bottom of the corresponding simulated door. The garage door 410 further includes round doorknobs 436 to enhance the appearance of doors.

Referring now to FIGS. 15-19 another embodiment of an overhead garage door 510 is shown that illustrates various aspects of the present invention pertaining to seams between the hingedly-connected sections, such as concealing the seams and improving the interconnection of adjacent sections at the seam region therebetween. As with the previous embodiments, garage door 510 includes decorative faøade elements, such as light-transmitting panels 512, which simulate two sets of light-transmitting doors commonly known as French doors. However, aspects of the present invention pertaining to seams between the sections may be practiced with other door configurations, which may or may not simulate light-transmitting doors or even include light-transmitting elements.

Figure 15:
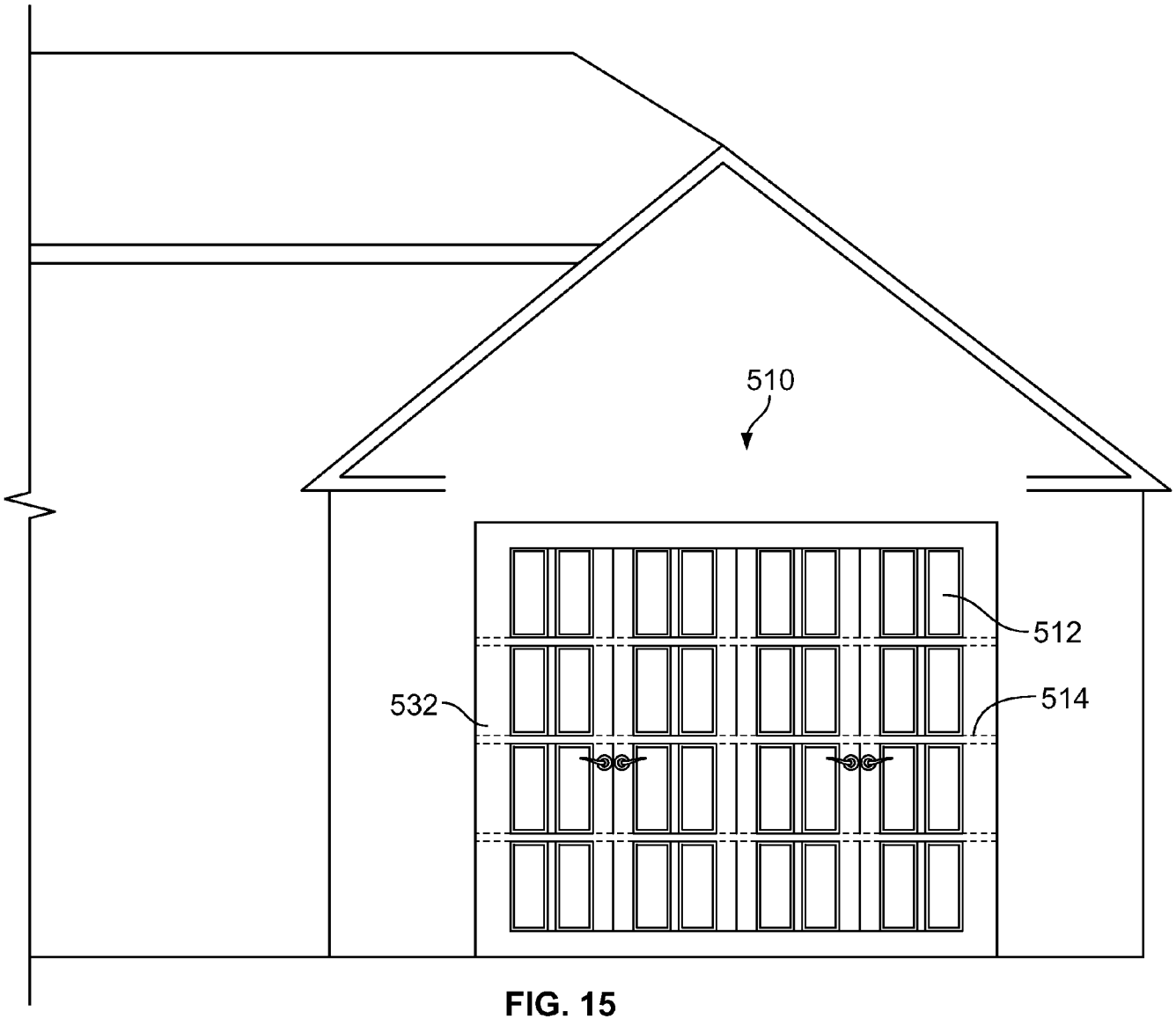
FIG. 15 shows an exterior elevational view of yet another embodiment of an overhead garage door in accordance with the present invention.
Figure 16:
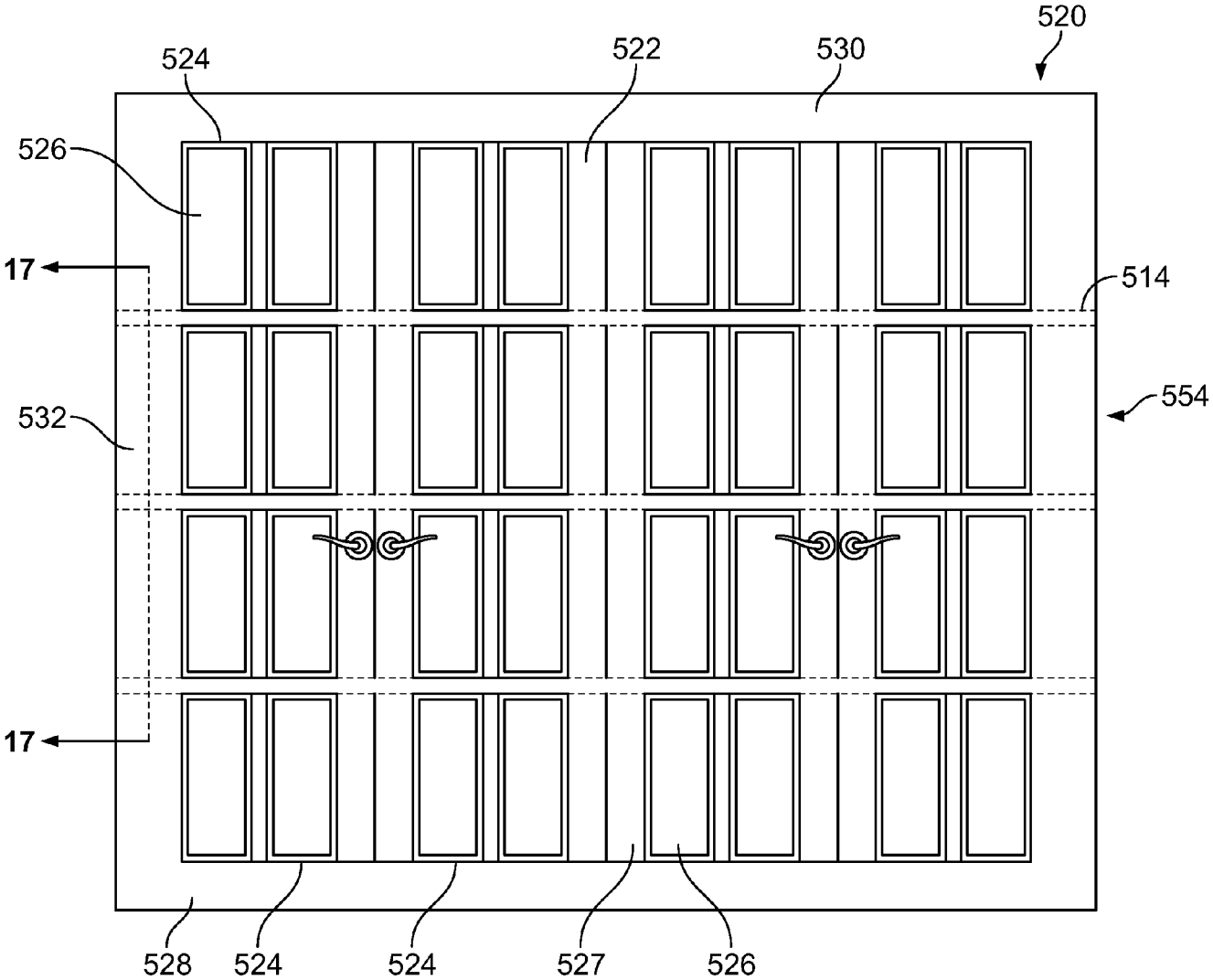
FIG. 16 is a front elevational view of the garage door of FIG. 15.

As shown in FIGS. 15 and 16, overhead garage door 510 includes a door 522, four arrays 524 of light-transmitting panels 526, end stiles 528 and 530 that form a top and bottom portion of door 522, guide rollers (not shown) and guide tracks (not shown). Door 522 includes horizontal sections 532 arranged in a vertical stack, and hinges 534 (FIG. 18) pivotally connecting adjacent horizontal sections 532. When installed on a building, guide rollers (not shown) attached to edge portions of the horizontal sections are retained in a guide track (not shown), which is attached to the garage. The track may have a vertical section and a horizontal section that generally form a right angle to guide the door from a vertical position to a horizontal position. The garage door opens and closes by rolling on the guide rollers along the guide tracks from a vertical closed position to an overhead horizontal open position, and vice versa, as is known in the art. Horizontal sections 532 are hingedly connected together to allow them to bend around the angled transition between the vertical section of guide track and the horizontal section of guide track.

Figure 18:
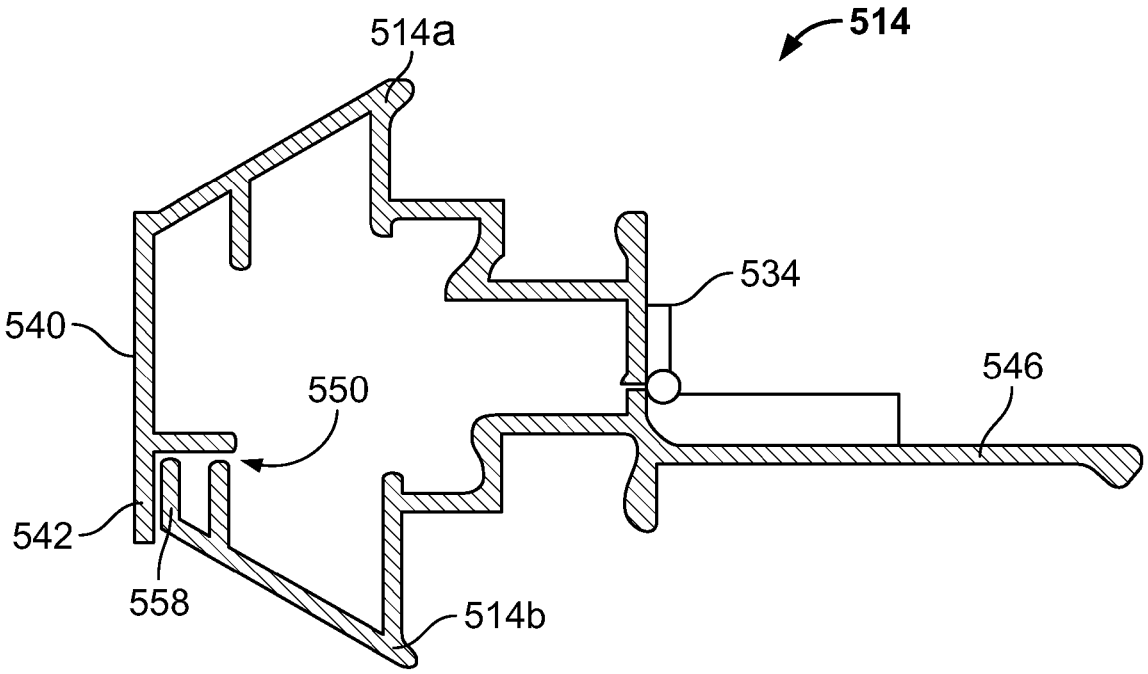
FIG. 18 is a cross sectional view of the set of meeting rails of FIG. 16.

Garage door 510 also includes a concealing apparatus, such as meeting rails 514, which are located at the joint between adjacent horizontal sections 532. As shown in FIG. 18, the meeting rails 514 are a pair of complementary pieces, an upper meeting rail 514*a* and a lower meeting rail 514*b*, that are joined by a hinge, such as surface mounted hinge 534. As the door 510 moves between a horizontal, open position and a vertical, closed position, adjacent sections 532 bend about hinge 534 to accommodate the angled transition between the two positions. Upper meeting rail 514*a* is attached to a bottom portion of an upper section 532 and rotates about hinge 534 with respect to lower meeting rail 514*b*, which is attached to an upper portion of an adjacent section. When the horizontal sections 532 are stacked in a closed position, a seam 550 (FIG. 18) is created where the two sections meet. Meeting rails 514 act as a concealing apparatus to mask seam 550 that is formed between adjacent sections.

Figure 17:
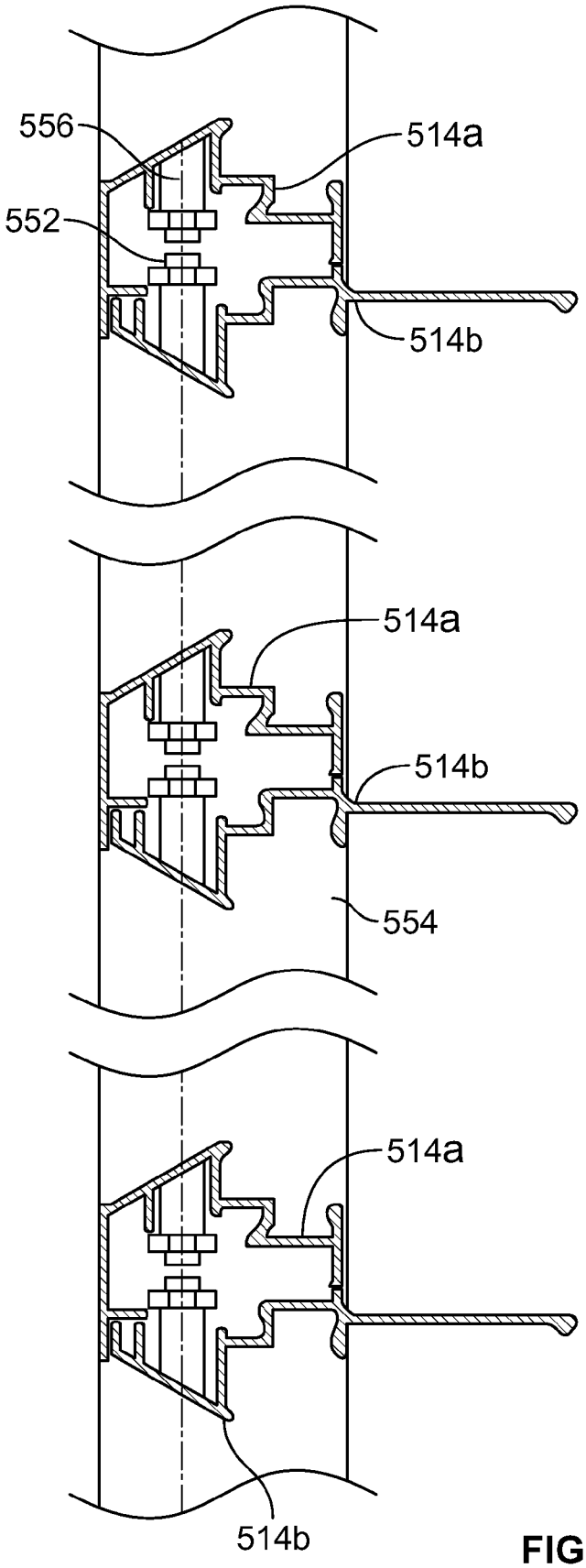
FIG. 17 is a cross sectional view of the garage door of FIG. 16 taken along line 17-17.

A pair of meeting rails for a particular section can be attached to each other via through bolts or other fasteners connecting them to the body of their respective section. As shown in FIG. 17, a first meeting rail (e.g., 514*a*) for a particular section can be connected to an opposite meeting rail (e.g., 514*b*) for the particular section via fasteners, such as a series of through bolts 552. As shown, bolt 552 extends vertically from the first one of the rails, through a body portion 554 of the section, and to the opposite one of the rails. If the section is one of the top or bottom sections for the door, the through bolt could attach to either the top stile 530 (FIG. 16) or the bottom stile 528 and extend through the section's body to a rail on the opposite side of the section. As further shown in FIG. 17, through bolts 550 may include a collar 556 that is bevel cut to mate with geometric features (e.g., angles) of the respective meeting rail 514*a* or 514*b*, which can strengthen the structural connection and aid with its assembly.

Through bolts 552 act in tension to draw the opposite rails or rail/stile pair toward each other and, thereby, to sandwich the body portion between the pair in compression. As shown in FIG. 16, the body portion 554 can include an arrangement of light-transmitting panels 526 and structural supports 527, such as solid panels. As discussed above for other embodiments, the panels may be formed from metal (e.g., aluminum), wood or other types of support materials.

Meeting rails 514*a* and 514*b* may be made from various substantially rigid materials, such as aluminum, steel and rigid plastic materials. In one embodiment, the rails are made from aluminum, such as 6063T-3 aluminum. Rails made from aluminum can be relatively lightweight while providing a robust hinge apparatus with durable mating surfaces, which can maintain its shape for many years through multiple openings and closings of the door. The rails may be manufactured through various processes, such as by extruding aluminum or plastic, welding steel pieces together, or thermoforming plastic materials. In addition, the meeting rails 514*a* and 514*b* can be manufactured to appear as a material similar to that of the rest of the door and of the same color to match the exterior appearance of the door 510.

As further shown in FIG. 18, upper rail 514*a* and lower rail 514*b* are preferably asymmetrical. As discussed further below, their asymmetrical shapes can provide advantages, such as masking seams between door sections, aiding the assembly and structural integrity of door sections, and enhancing door rigidity in the closed position. Upper rail 514*a* can include a flat front surface 540 that is visible on the front of garage door 510 when installed. The flat front surface 540 can reduce the appearance of seam lines created by adjoining horizontal sections 532. The flat front surface 540 is configured to cover the seam between the section to which it is attached and the adjacent section and, thereby, to provide a more aesthetically pleasing door than one having visible seams. As shown, lower rail 514*b* may have an extended flange 546 that provides a surface to which hinge 534 can be mounted. As the door is raised or lowered, the meeting rails 514*a* and 514*b* rotate apart about hinge 534 to allow the door to move to the open or closed position.

In addition to providing aesthetic benefits gained by concealing seams between sections, the flat front surface 540 of upper rail 514*a* can also aid the insulation properties of the door. The flat front surface 540 includes an overlap 542 that overlaps a corresponding under surface 558 of the lower rail and, thereby, provides a tight seal at seam 550. The overlap seal configuration can provide protection against air and moisture seeping between the horizontal panels of the door and, thus, provide a weather-tight seal. The overlap seal configuration further prevents any moisture that may possibly seep behind the flat front surface 540 from penetrating further. Any such moisture would meet with under surface 558 of the lower rail and will not be able to penetrate to the inside of the door. The overlap seal configuration also encourages precipitation and other fluids contacting the exterior of the door to move downward past the seam without being able to enter it. In general, the overlap seal configuration acts as a barrier against wind, moisture and debris, to reduce undesired infiltration into the garage.

Additional advantages can be realized when a concealing apparatus, such as meeting rails 514, is used with a sectional door having aesthetic features, such as faøade elements or other elements that simulate the appearance of something other than a sectional door. For instance, the use of meeting rails 514 with an overhead garage door that incorporates French door faøade elements can enhance the faøade elements by concealing the seams 550 between adjacent sections. The seams created by the adjoining horizontal pieces can detract from the appearance of the door and the desired look created by the French door design. Concealing the horizontal seams in such an overhead garage door provides a uniform door appearance that is consistent with actual French doors and other types of vertically hinged doors.

Figure 19:
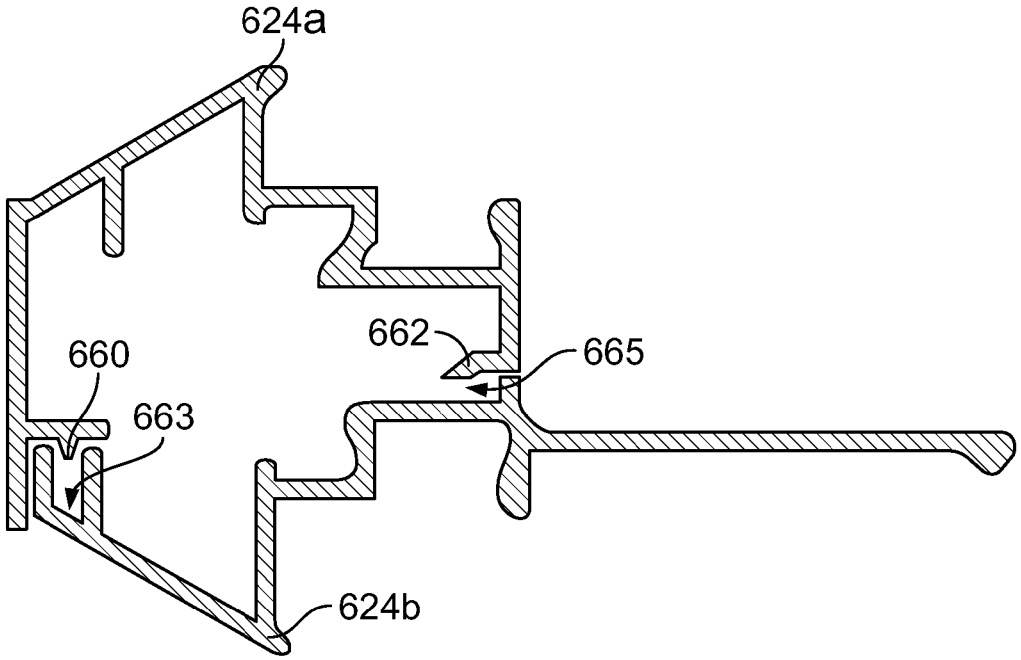
FIG. 19 is a cross sectional view of a set of meeting rails according to another embodiment of the invention.

FIG. 19 depicts an alternate embodiment of the meeting rails 624*a* and 624*b* for use with a sectional door, such as garage door 510. Upper meeting rail 624*a* includes an additional lip 660 protruding downward. This lip 660 may be located on a horizontal portion of the rail adjacent to the flat front surface 640 of upper guide 624*a*. An additional lip 662 may be located on the upper guide 624*a* and may protrude from the vertical back portion of the upper guide 624*a*. This lip protrudes toward the flat front surface 640 and downward toward the lower meeting rail 624*b*. The additional lips 660 and 662 may be formed in each of the meeting rails 624*a* and 624*b* during manufacture. For instance, the meeting rails 624*a* and 624*b* can be formed by an extrusion process to include additional lips 660 and 662.

Additional lips 660 and 662 can aid in installation of the meeting rails 624*a* and 624*b*. The lips 660 and 662 can assist with aligning the meeting rails 624*a* and 624*b* to thereby simplify installation of adjacent sections to each other. In addition, the lips 660 and 662 can aid with locking the meeting rails 624*a* and 624*b* together while the door is in a closed position. The lips 660 and 662 permit the upper meeting rail 624*a* to interconnect with corresponding recesses 663 and 665 of the lower meeting rail 624*b* to enhance the security and structural integrity of the door when in the closed position.

Figure 20:
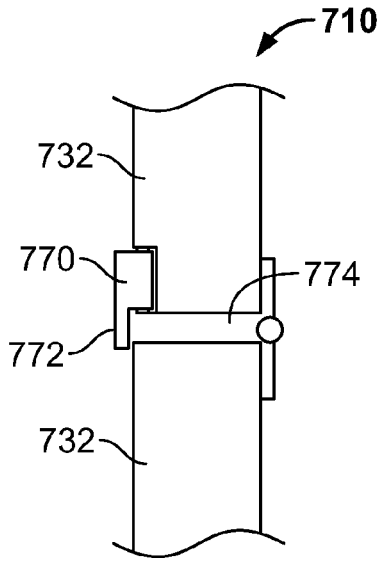
FIG. 20 is a cross sectional view of a portion of an overhead garage door according to a further embodiment of the invention.

FIG. 20 shows a concealing apparatus 710 according to another embodiment of the invention. As shown, concealing apparatus 710 generally includes an overlap plate 770 attached to a lower portion of a door section 732, such that it overlaps and conceals a gap 774 formed between adjacent sections. Plate 770 may be attached to garage door section 732 by way of a fastener, e.g., screw, bolt, and the like. The overlap plate 770 may also have an overlapping portion 772 that can conceal a seam 774 created between two adjoining horizontal sections 732 of the garage door 710. The overlap plate 770 can act as a barrier against wind, moisture and debris and will also mask the seam 774 to improve the appearance of the door 710.

Referring to FIG. 15 and FIGS. 21 through 24A-E, an alternative embodiment of an overhead garage door 510 is shown that illustrates various aspects pertaining to providing a pinch resistant function between the hingedly-connected sections. Referring generally to FIG. 15, garage door 510 may include decorative faøade elements, such as light-transmitting panels 512, which simulate two sets of light-transmitting doors commonly known as French doors. However, aspects of the present invention pertaining to pinch resistant functions between the door sections may be practiced with other door configurations, which may or may not simulate light-transmitting doors or include light-transmitting elements.

Referring to FIG. 15, overhead garage door 510 includes a door 522, four arrays 524 of light-transmitting panels 526, end stiles 528 and 530 that form a top and bottom portion of door 522, guide rollers (not shown) and guide tracks (not shown). Door 522 includes horizontal sections 532 arranged in a vertical stack, and hinges 534 (FIG. 18) pivotally connecting adjacent horizontal sections 532. When installed on a building, guide rollers (not shown) attached to edge portions of the horizontal sections are retained in a guide track (not shown), which is attached to the garage. The track may have a vertical section and a horizontal section that generally form a right angle to guide the door from a vertical position to a horizontal position. The garage door opens and closes by rolling on the guide rollers along the guide tracks from a vertical closed position to an overhead horizontal open position, and vice versa, as is known in the art. Horizontal sections 532 are hingedly connected together to allow them to bend around the angled transition between the vertical section of guide track and the horizontal section of guide track.

Figure 21:
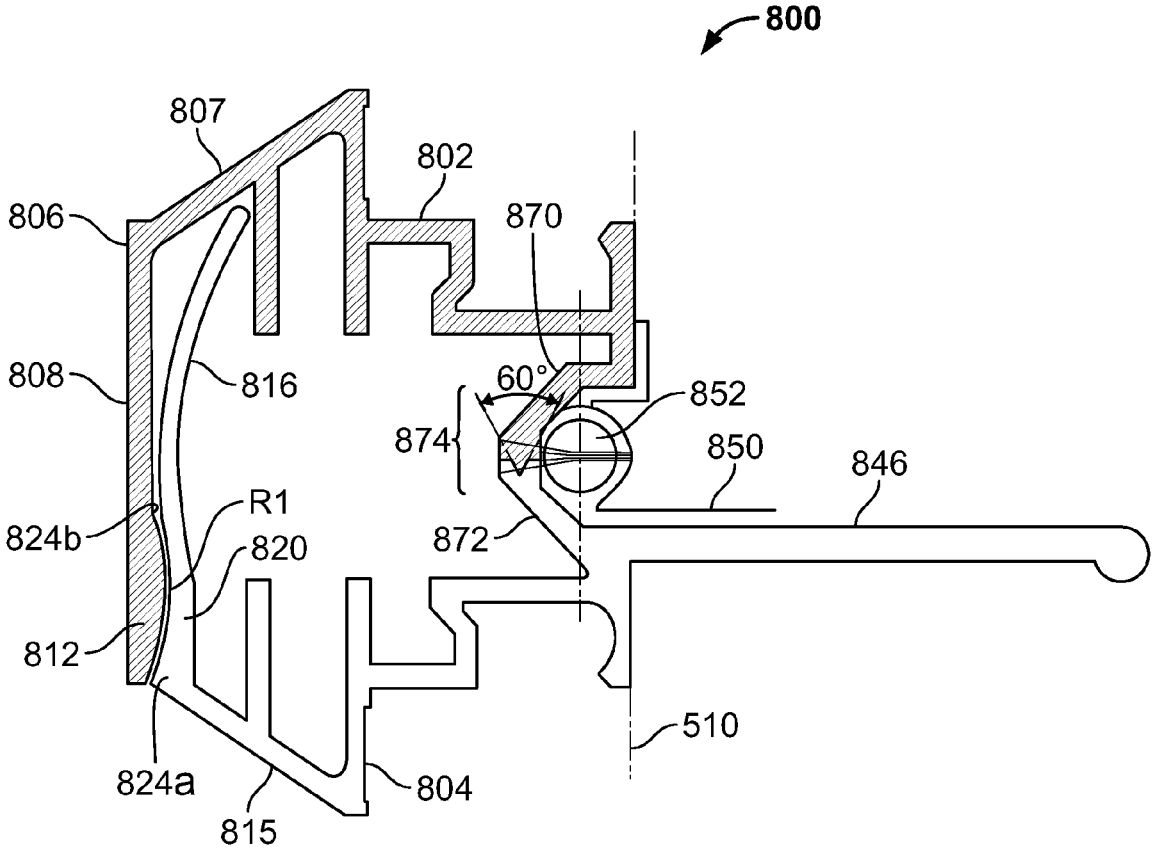
FIG. 21 is a cross section view of a meeting railing system according to one embodiment.
Figure 22:
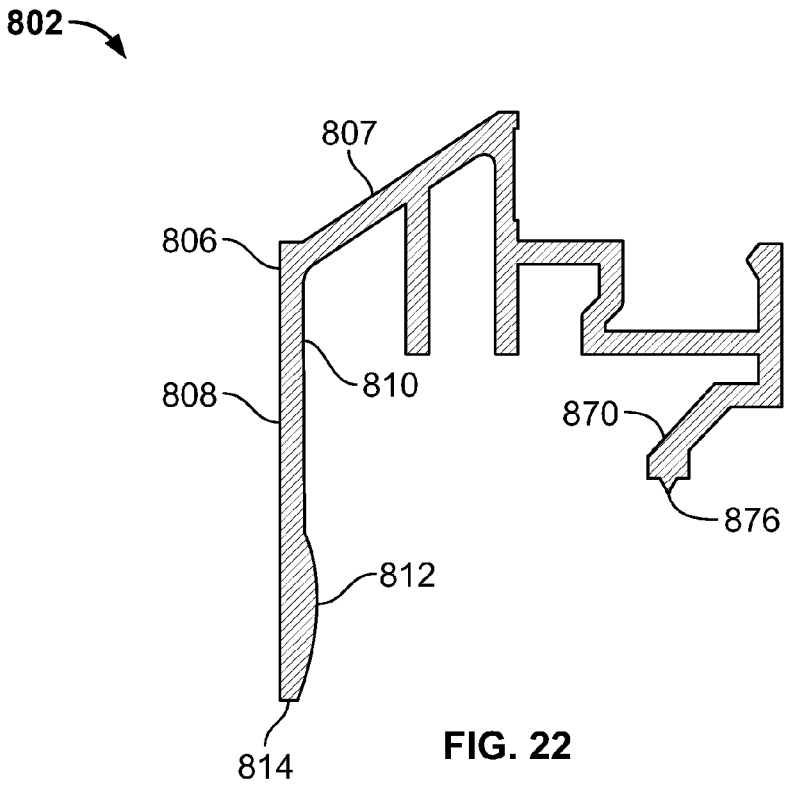
FIG. 22 is a cross section view of one member of the meeting rail system shown in FIG. 21.
Figure 23:
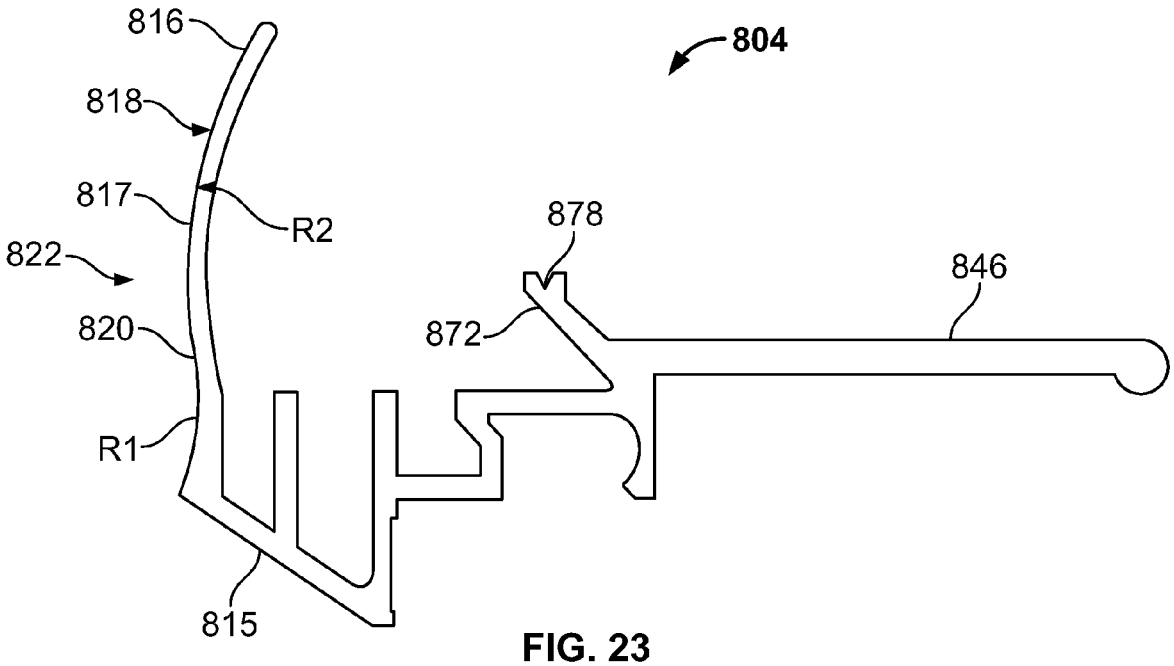
FIG. 23 is a cross section view of one member of the meeting rail system shown in FIG. 21.

FIGS. 21-23 illustrate an alternative embodiment of the meeting rail system 800 for a garage door 510 (FIG. 15). The meeting rail system 800 is configured to provide a pinch resistant type of garage door to protect the detents of a user's limb, such as a finger of the user, from being engaged between the horizontal sections 532. Meeting rail system 800 comprises an upper rail 802 and a lower rail 804. The upper rail 802 and lower rail 804 are provided between adjacent horizontal sections of the door 510. The upper rail 802 is mounted to the upper horizontal section to extend laterally across the width of the door 510. Likewise, the lower rail is mounted the lower section of the door. The upper rail 802 and the lower rail 804 are hingely connected together to move in a complementary manner when the garage door sections 532 move on the guide track (not shown). In one construction shown in FIGS. 21 and 22, the upper meeting rail 802 includes a vertical leg 806 which has a front face 808 and a rear face 810. The front face 808 is substantially planar, but could have other surface configurations. The rear face 810 includes a convex protrusion portion 812 disposed near the distal end 814 of the vertical leg 806. The remainder of the rear face 810 is substantially planar, but could be other configurations. The vertical leg 806 is connected to an angular portion 807 which is mounted to the bottom end of the door section.

Referring to FIGS. 21 and 23, the lower meeting rail 804 is provided with an upstanding portion 816 having a front face 817 with a compound arcuate surface 818. The upstanding portion 816 is connected to an angular portion 815 which is mounted to the top end of the door section. The compound arcuate surface 818 includes a concave portion 820 having a complementary curvature to the curvature of the convex protrusion portion 812 for mating engagement with the vertical leg 806 of the upper rail 802. The remainder of the surface 818 has a convex curvature. The curvature of the arcuate surface 818 changes from the concave configuration of portion 820 to a convex curvature at an inflection region 822. The inflection region 822 is generally located by measuring from the lower end 824 of the front face 817 to the upper end 824 of the convex protrusion 812 of the upper meeting rail 802. In one arrangement, the radius of curvature R1 of the concave portion 820 is small than the radius curvature R2 of the remainder of the arcuate surface 818. This general arrangement provides the benefit of safety for a pinch resistant operation of the garage door.

FIGS. 24A-E illustrates at least one operational sequence of the meeting rail system acting as a pinch resistant or pinch proof apparatus. The upper rail 802 and the lower 804 for have an interlocking function. In the operational sequence, when the door is opened in a fashion as a rollup of the garage door, the meeting rails 802, 804 separate from each other by pivoting on the hinge. During the rotational motion of the meeting rails, the upper rail 802 with the vertical leg 806 moves in a curvilinear manner to generally follow the curvature of the upstanding leg of the lower meeting rail 804. The separation distance is maintained to be sufficiently small between the protrusion portion 812 and the arcuate surface 818 so that a finger of a person is pushed downward, rather than being pinched between the surface 818 and protrusion portion 812.

Similar to the embodiment shown in FIGS. 15-20, lower meeting rail 804 has a flange 846 that can be used to mount or otherwise retain a hinge 850 with pivot pin 852 (see FIGS. 21 and 23). The particular hinge mounting arrangement is shown in FIG. 21. In one embodiment shown in FIG. 21, the pivot pin 852 is provided in a rear position with respect to garage door section. In another embodiment, the pivot pin 852 is disposed in a recessed arrangement between the upper meeting rail 802 and the lower meeting rail 804. This recessed arrangement is provided by a structure of an upper rotation limiter 870 and lower rotation limiter 872, disposed on the upper meeting rail 802 and lower meeting rail 804, respectively. Upper rotation limiter 870 and lower rotation limiter 872 define a rotation limiter system 874 that stops downward rotation of the upper meeting rail 802 with respect to the lower meeting rail 804. (Counter-clockwise rotation as shown in the FIGS. 21 and 24A-24E). Referring to FIGS. 21-23, the upper rotation limiter 870 and lower rotation limiter 872 are planar and angled from the vertical. The distal end of the upper rotation limiter 870 includes a protrusion portion 876 that becomes received in a corresponding shaped cavity 878 on the distal end of the lower rotation limiter 872. This arrangement of the protrusion portion 876 and cavity 878 enables a stable and strong support when the meeting rails 802, 804 are in a closed position. When in meeting rails are in a closed position, the protrusion-cavity arrangement, prevents lateral twisting of the door about a longitudinal axis along the width of the door. In the embodiment shown in FIGS. 21-24E, the protrusion portion 827 has a triangular cross section and is prism-shaped in viewed in a three-dimensional space. This triangular configuration provides a greater sectional area to reduce shearing loads and provides a benefit to prevent lateral twist as noted in the foregoing. Nevertheless, protrusion portion 827 can have other shapes and sizes. Further, in operation, as the protrusion portion 872 of upper rotation limiter 870 enters the cavity 878 of the lower rotation limiter 872, the upper meeting rail 802 becomes generally aligned with the lower meeting rail 804. It should be noted that between 0.5 degrees to about 2 degrees from vertical, the upper meeting rail 802 starts to become generally aligned with the lower meeting rail 804 depending on the height of protrusion portion 872.

Figure 24B:
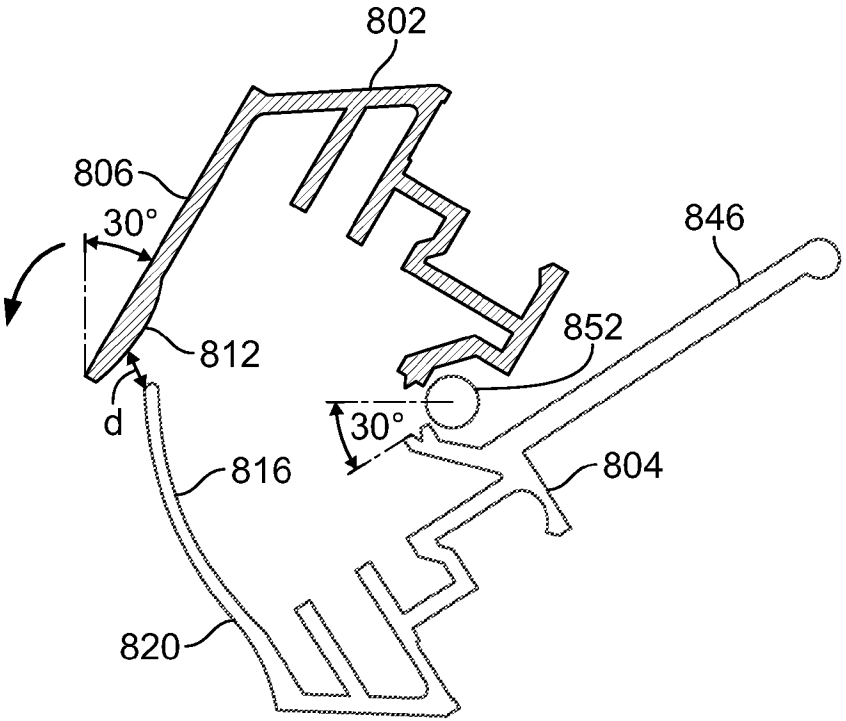
FIGS. 24A-E are cross section views illustrating at least one operational sequence of one embodiment.
Figure 24A:
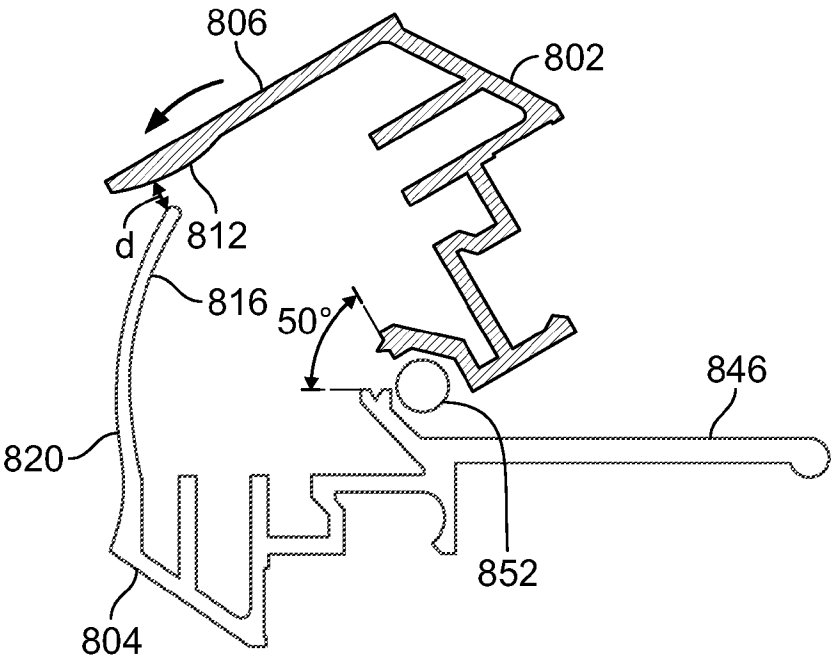

FIG. 24A shows at least two adjacent garage door sections in an open position, such as when the upper door section is on a curved section of a guide track. For ease of explanation, the sectional doors are not shown. Hence, FIG. 24A shows upper meeting rail 802 pivoted about pivot pin 852 above lower meeting rail 804. As seen in FIGS. 24A-24E, the pivot pin 852 is provided in a rear position for enabling the upper meeting rail 802 to rotate so that the distance (d) between the convex protrusion 812 and surface 818 is small. This small distance (d) provides safety feature so that finger of a user is pushed away, rather than pinched between door sections.

Figure 24D:
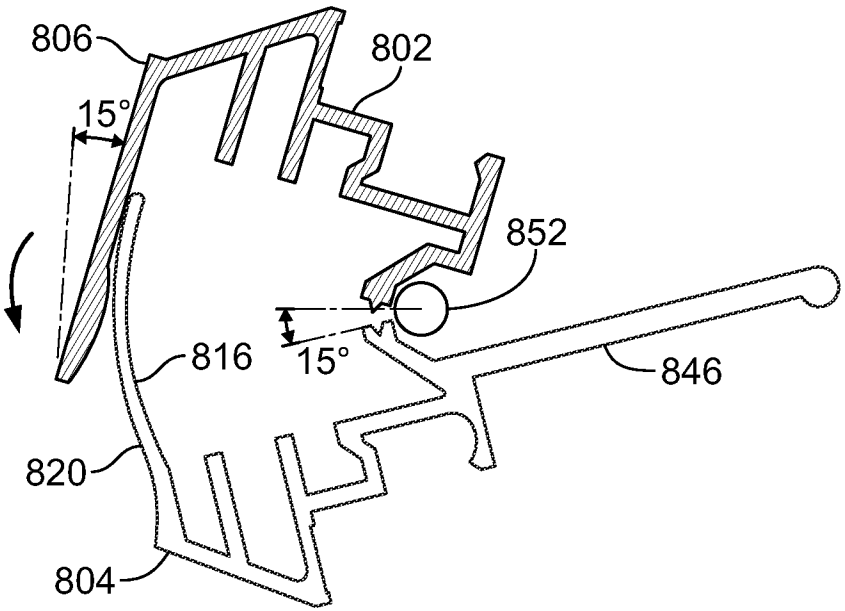
Figure 24C:
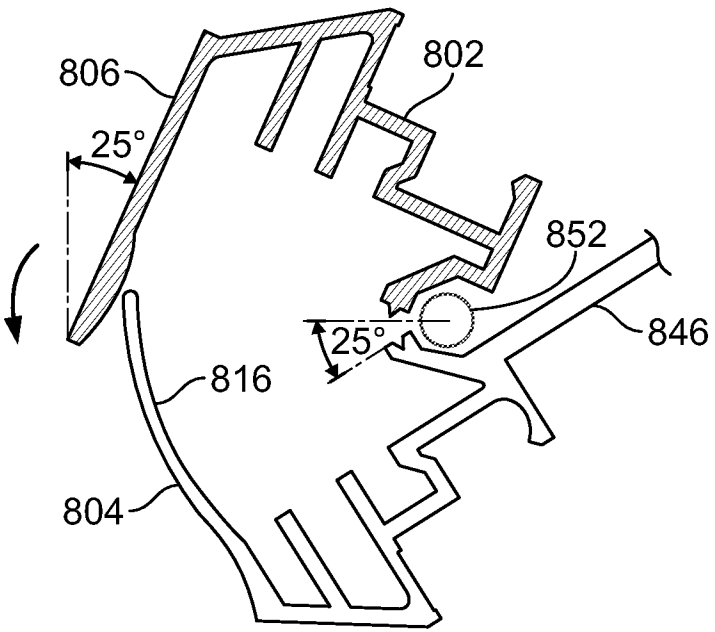
Figure 24E:
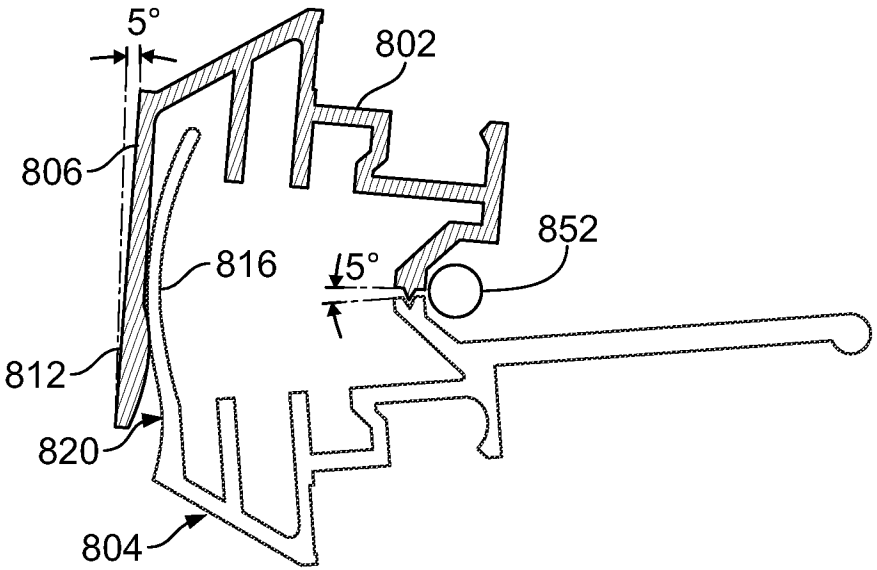

FIG. 24B illustrates the sectional doors in one downward closing position with upper rail approximately 30 degrees from the vertical. FIG. 24C illustrates the sectional doors in a subsequent downward closing position with upper rail approximately 25 degrees from the vertical. FIG. 24D illustrates sectional doors in subsequent downward closing position with upper rail approximately 15 degrees from the vertical. FIG. 24E illustrates sectional doors in another subsequent downward closing position with upper rail approximately 5 degrees from the vertical.

While the meeting rails 802 and 804 provide a safety benefit to prevent pinching of user's finger, the vertical leg of upper rail 802 in combination with the compound arcuate surface 818 of meeting rail 802 aids in the insulation properties of the door. The concave portion 820 of surface 818 having a complementary curvature to the curvature of the convex protrusion portion 812, engagements with the vertical leg 806 of the upper rail 802 to a create a seaming arrangement to prevent air infiltration. The concave-convex configuration can provide protection against air and moisture seeping between the horizontal panels of the door and, thus, provides a substantially weather-tight seal. The concave-convex configuration further encourages precipitation and other fluids contacting the exterior of the door to move downward past the interface for the two meeting rails when the garage door is closed. In general, the overlap seal configuration acts as a barrier against wind, moisture and debris, to reduce undesired infiltration into the garage.

Meeting rails 802 and 804 may be made from various substantially rigid materials, such as aluminum, steel and rigid plastic materials. In one embodiment, the rails are made from aluminum, such as 6063T-3 aluminum. Rails made from aluminum can be relatively lightweight while providing a robust hinge apparatus with durable mating surfaces, which can maintain its shape for many years through multiple openings and closings of the door. The rails may be manufactured through various processes, such as by extruding aluminum or plastic, welding steel pieces together, machining metals, or thermoforming plastic materials. In addition, the meeting rails 802 and 804 can be manufactured to appear as a material similar to that of the rest of the door and of the same color to match the exterior appearance of the door 510 (FIG. 15).

Meeting rails 802 and 804 can be fastening a selected garage door section via bolts or other mechanical fasteners. This configuration is generally illustrated in FIG. 17. Nevertheless, other meeting rails 802 and 804 could be bonded or otherwise attached of the ends of the garage door.

Although the subject matter has been described in language specific to structural features, it is to be understood that the subject matter defined in the appended claims is not necessarily limited to the specific features described above. Rather, the specific features described above are disclosed as example forms for implementing the claims. Further, it is appreciated that aspects of the invention discussed herein may be practiced alone or in combination with other aspects, and they may be practiced in a variety of door configurations.

The invention claimed is:

1. A sectional overhead garage door, comprising:

a first door section having a front rear side;

a second door section having a front and rear side; the first door section and the second door section being configured to be hingedly attached to each other at a location proximate to the corresponding rear side of each said first door section and said second door section for rotation in a direction there about;

an upper rail being attached to the first door section, the upper rail having a front surface, an opposing rear surface and a distal edge connecting front surface and rear surface, the rear surface having a convex protrusion extending in a direction away from the rear surface; and a lower rail being attached to the second door section, the lower rail having a front surface and an opposing rear surface, the front surface having a concave portion and a concave portion which mates with the convex protrusion which extends rearward into the concave portion of the lower rail and away from the front surface of the upper rail when the first section and the second section are rotated in said direction to a closed position;

wherein the concave portion of the lower rail has a radius of curvature smaller than a radius of curvature of the convex portion of the lower rail, and a rail front vertical leg of each said upper and lower rail travels during rotational motion of the upper and lower rails without engaging in said direction of rotation until the protrusion mates with he concave portion such that the edge is exposed when the first and second door sections are open or closed;

wherein the top rail includes a first rotation limiter adjacent to a rear side of the first door section remote from the front side thereof, and the bottom rail includes a second rotation limiter adjacent to the rear side of the second door section and remote from the front side thereof; the first rotation limiter having a triangular cross-sectional shaped protrusion, the second rotation limiter having a cavity; the first rotation limiter configured to be received in the second rotation limiter via the triangular cross-sectional shaped protrusion and the cavity.

2. The garage door of claim 1, wherein the front surface of the lower rail has a convex portion forming a compound curvature surface having an inflection region between the concave portion and the convex portion.

3. The sectional garage door of claim 1, wherein the upper rail and the lower rail comprise a metal material.

4. The sectional overhead garage door of claim 1, wherein the upper rail and the lower rail comprise aluminum.

5. The sectional overhead garage door of claim 4, wherein the upper rail and the lower rail are made from an extrusion process.

6. The sectional overhead garage garage door of claim 1, wherein the convex protrusion of the upper rail has the same radius value as the radius value of the concave portion of the lower rail.

7. The sectional overhead garage door of claim 1, incorporating decorative elements of a house facade, the door comprising:

at least a first plurality of light-transmitting panels on the door having a plurality of rows and a plurality of columns and configured to give the appearance of a French door;

a plurality of horizontal panels arranged in a stack, wherein the plurality of light-transmitting panels are located on the horizontal panels;

a pinch resistant apparatus between the horizontal panels; and a hinge connecting the plurality of horizontal panels.

8. The garage door of claim 7, wherein the pinch resistant apparatus comprises an upper meeting rail and a lower meeting rail.

9. The garage door of claim 8, wherein the curved surface includes a convex portion.

10. The garage door of claim 9, wherein the concave portion has a radius of curvature which is smaller that a radius of curvature of the convex portion.

11. The garage door of claim 8, wherein the upper meeting rail and lower meeting rail comprise aluminum.

12. The overhead garage door of claim 11, wherein the upper meeting rail and the lower meeting rail are made from an extrusion process.

13. An overhead garage door comprising;

a plurality of horizontal panels each having a front side and a rear side arranged in a stack;

a pinch resistant apparatus between the horizontal panels comprising an upper meeting rail having a front side, a rear side and a distal edge connecting the front and rear sides thereof, and a lower meeting rail having a front side and a rear side, wherein the rear side of the upper meeting rail has a convex protrusion, the front side of the lower meeting rail has a concave portion which engagingly mates with the convex protrusion, the convex protrusion of the upper rail extending rearward, away from a front surface of the overhead garage door and toward the concave portion of the lower meeting rail;

a hinge located adjacent the rear side of said plurality of horizontal panels, said hinge connecting the upper meeting rail and lower meeting rail of each of one or more adjacent pairs of the plurality of horizontal panels for motion between open and closed portions thereabout in a direction of rotation; the hinge including a first rotation limiter provided on the upper meeting rail adjacent the rear side thereof; the first rotation limiter having a polygonal cross-sectional shaped protrusion; and a second rotation limiter provided on the lower meeting rail; the second rotation limiter having a cavity; the first rotation limiter configured to be received in the cavity of the second rotation limiter by way of the polygonal cross-sectional shaped protrusion when the hinge closes; and said upper and lower meeting rails engaging only in a direction transverse of the direction of rotation such that the distal edge of the upper meeting rail is exposed.

14. A pinch resistant apparatus located between adjacent pairs of corresponding upper and lower panels of an overhead garage door having front and rear sides comprising:

a top rail including an upper leg located at the front side of the upper panel, said upper leg having a front side, a rear side and a distal edge connecting the front and rear sides, the rear side of the upper leg being formed with a convex protrusion;

a bottom rail including a lower leg located at the front side of the lower panel, said lower leg having a front side and rear side, the front side of the lower panel being formed with a compound curvature surface including a convex portion;

a hinge connecting the top rail and the lower rail, said hinge located adjacent to both the rear side of the upper panel and the rear side of the lower panel for movement between open and closed positions along a direction of rotation, said hinge having a first rotation limiter provided on the top rail adjacent to the rear side of the upper panel and a second rotation limiter provided on the bottom rail adjacent to the rear side of the lower panel; the first rotation limiter having a protrusion member, the second rotation limiter having a recess; the first rotation limiter configured to be received in the second rotation limiter via the protrusion member and the recess in the direction of rotation;

and wherein the rear side of the upper rail and the front side of the bottom rail engage in a direction transverse to the direction of rotation when the top rail and bottom rail rotate between the open position and the closed position, such that the convex protrusion extends rearward, away from a front surface of the overhead garage door, toward and mates engagingly within a concave portion of the compound curvature surface in a closed position and the distal edge of the top rail remains exposed when the panels are in the open and closed positions.

* * * * *